US007070448B2

(12) United States Patent
Khemakhem

(10) Patent No.: US 7,070,448 B2
(45) Date of Patent: Jul. 4, 2006

(54) COAXIAL/TRIAXIAL ADAPTER ASSEMBLY INCLUDING AN ADAPTER AND INTERCHANGEABLE CONNECTOR ENDS AND METHOD

(75) Inventor: M'Hamed Anis Khemakhem, Eden Prairie, MN (US)

(73) Assignee: ADC Telecommunications, Inc., Eden Prairie, MN (US)

( * ) Notice: Subject to any disclaimer, the term of this patent is extended or adjusted under 35 U.S.C. 154(b) by 0 days.

(21) Appl. No.: 10/809,665

(22) Filed: Mar. 25, 2004

(65) Prior Publication Data

US 2005/0215113 A1 Sep. 29, 2005

(51) Int. Cl.
*H01R 9/05* (2006.01)
*H01R 13/62* (2006.01)
*H01R 4/38* (2006.01)

(52) U.S. Cl. ..... 439/580; 439/322

(58) Field of Classification Search ..... 439/580, 439/578, 579, 581, 583, 638, 639, 628, 322
See application file for complete search history.

(56) References Cited

U.S. PATENT DOCUMENTS 3,673,546 A * 6/1972 Green et al. ..... 439/172
3,828,305 A 8/1974 Hogendobler
4,030,797 A 6/1977 Nieman
4,593,964 A 6/1986 Forney, Jr. et al.
4,813,887 A * 3/1989 Capp ..... 439/580
5,062,808 A * 11/1991 Hosler, Sr. ..... 439/580
5,281,167 A 1/1994 Le et al.
5,595,499 A 1/1997 Zander et al.
5,660,564 A 8/1997 Yamanashi et al.
5,769,662 A 6/1998 Stabile et al.
5,893,777 A 4/1999 Kantor
5,967,852 A 10/1999 Follingstad et al.
6,109,963 A 8/2000 Follingstad et al.
6,126,482 A 10/2000 Stabile
6,146,192 A 11/2000 Cabalka et al.
6,231,380 B1 5/2001 Cabalka et al.
6,561,848 B1 5/2003 Khemakhem et al.
6,575,786 B1 6/2003 Khemakhem et al.
2002/0025718 A1 2/2002 Cabalka et al.

OTHER PUBLICATIONS

Drawings and Specification for Cable Group Adapters listed on Kings Electronics website, 1 page (Jan. 15, 1996).
Drawings and Specification for Cable Group Adapters listed on Kings Electronics website, 1 page (Jan. 10, 1990).
Drawings and Specification for Cable Group Adapters listed on Kings Electronics website, 1 page (Apr. 20, 1995).
Drawings and Specification for Cable Group Adapters listed on Kings Electronics website, 1 page (Oct. 31, 1995).

(Continued)

*Primary Examiner*—Chandrika Prasad
(74) *Attorney, Agent, or Firm*—Merchant & Gould P.C.

(57) ABSTRACT

An adapter for connecting coaxial cable connectors. The adapter has first and second ends for mounting cable connectors for various genders and styles as required for connecting two existing cable connectors. The connectors may be selectively changed as required to mate with the gender and style of the cable connectors mounted to the coaxial cables to be joined. A method of assembling an adapter for connecting coaxial cables that includes selecting first and second cable connector ends for the adapter to mate with the cable connectors to be joined.

37 Claims, 34 Drawing Sheets

OTHER PUBLICATIONS

Drawings and Specification for Cable Group Adapters listed on Kings Electronics website, 1 page (Apr. 25, 1995).
Kings Electronic Co., Inc., Broadcast Products Catalog 803 © 2003, Table of Contents pp. 27-36.
Print of Cable Group Adapter Page on Kings Electronics website, 1 page, undated.
W.W. Fischer S.A. Triaxial Connectors Series 1051 A004 Product Catalog, Front Cover, pp. 4, 5, 13, undated.

* cited by examiner

COAXIAL/TRIAXIAL ADAPTER ASSEMBLY INCLUDING AN ADAPTER AND INTERCHANGEABLE CONNECTOR ENDS AND METHOD

TECHNICAL FIELD

The present invention relates generally to coaxial cable connectors. More specifically, the present invention relates to triaxial cable connectors and adapters.

BACKGROUND

In broadcast communications installations, it is known to use coaxial cables with three conductors to electrically link different pieces of equipment, such as cameras or production facilities. Such triaxial cables are terminated in a variety of formats and genders of connectors to permit the cables to be connected to the equipment or to other cables. Triaxial cable connectors such as these are disclosed in the commonly owned U.S. Pat. Nos. 5,967,852; 6,109,963; 6,146,192; 6,231,380; 6,561,848; and 6,575,786, the disclosures of which are incorporated herein by reference.

It is known to have connectors which may be converted to mate with different formats and genders of triaxial connectors. However, these known connectors may require that a cable be reterminated to mount such a connector to the cable to be able to utilize the convertible connector. In some situations and installations, it not desirable or reasonable to require that such cables be reterminated.

An adapter for use with triaxial and other coaxial cables which permits existing known connectors to mate with connectors of a different format or gender is desirable.

SUMMARY

The present invention relates to coaxial connector assembly including an adapter. The adapter includes a first and a second end, with a center conductor and a first outer conductive shell at each end. The center conductors of each end are electrically connected and the first outer conductive shells of each end are electrically connected, and the center conductors are electrically isolated from the first outer conductive shells. The assembly also includes a first cable connector mounted to the first end of the adapter. The first cable connector includes a first end and a second end, the second end of the first cable connector adapted to engage the first end of the adapter and the first end of the first shell assembly adapted to mate with a first coaxial cable connector. The assembly also includes a second cable connector mounted to the second end of the adapter. The second cable connector including a first end and a second end, the second end of the second cable connector adapted to engage the second end of the adapter and the first end of the second cable connector adapted to mate with a second coaxial cable connector.

The present invention also relates to a coaxial connector assembly with an adapter. The adapter includes a first and a second end, a center conductor and a first outer conductive shell at each end. The center conductors of each end are electrically connected and the first outer conductive shells of each end are electrically connected, and the center conductors are electrically isolated from the first outer conductive shells. The assembly also includes a first cable connector removably mounted to the adapter about the first outer conductive shell at the first end of the adapter.

The first cable connector includes a first center conductor electrically connected to the center conductor of the first end of the adapter, a first conductive front shell electrically connected to the first outer conductive shell of the first end of the adapter, and a first insulator mounted between and electrically isolating the first center conductor and the first conductive front shell. The first cable connector further includes a first end and a second end. The second end of the first cable connector is adapted to releasably engage the first end of the adapter and the first end of the first cable connector is adapted to mate with a first coaxial connector.

The assembly also includes a second cable connector removably mounted to the adapter about the first outer conductive shell at the second end of the adapter. The second cable connector includes a second center conductor electrically connected to the center conductor of the second end of the adapter, a second conductive front shell electrically connected to the first outer conductive shell of the second end of the adapter, and a second insulator mounted between and electrically isolating the second center conductor and the second conductive front shell. The second cable connector further includes a first end and a second end. The second end of the second cable connector is adapted to releasably engage the second end of the adapter and the first end of the second cable connector is adapted to mate with a first coaxial connector.

The present invention further relates to a coaxial connector adapter with a central housing defining a central axial opening with a first end and a second end. An outer portion of the central housing proximate each end is threaded to receive a conductive outer body. An outer insulator is mounted within the central axial opening of the central housing. A first conductive shell extends through the outer insulator beyond the first and second ends of the central housing. The first conductive shell includes a first end and a second end, each threaded to receive a shell assembly, and the outer insulator electrically isolates the first conductive shell from the central housing. An inner insulator is mounted within the central axial opening of the central housing. A center conductor extends between the first and second ends of the central housing through the central axial opening mounted within the inner insulator.

The present invention still further relates to a triaxial cable connector system with an adapter with first and second ends, a first cable connector mounted to the first end and a second cable connector mounted to the second end. The first cable connector includes a front shell assembly including a conductive front shell and a center conductor mounted within and electrically isolated from the conductive front shell by a center conductor insulator. An outer insulator is positioned about the front shell assembly of the first cable connector and a conductive outer body positioned about the outer insulator and electrically isolated from the front shell assembly. The first cable connector defines a first connector gender and style.

A second cable connector is mounted to the second end of the adapter. The second cable connector includes a front shell assembly including a conductive front shell and a center conductor mounted within and electrically isolated from the conductive front shell by a center conductor insulator. An outer insulator is positioned about the front shell assembly, and a conductive outer body positioned about the outer insulator and electrically isolated from the front shell assembly. The second cable connector defines a second connector gender and style.

The assembly also includes a third cable connector including a front shell assembly including a conductive front shell and a center conductor mounted within and electrically isolated from the conductive front shell by a center conductor insulator. An outer insulator positioned about the front shell assembly, and a conductive outer body positioned about the outer insulator and electrically isolated from the front shell assembly. The third cable connector defines a third connector gender and style.

The center conductor of the first cable connector is electrically connected to center conductor of the second cable connector, the front shell of the first cable connector is electrically connected to the front shell of the second cable connector, and the conductive outer body of the first cable connector is electrically connected to the conductive outer body of the second cable connector. Either of the first or the second cable connector may be removed from the adapter and replaced with the third cable connector so that the center conductor of the third cable connector.

The present invention also relates to a method of assembling a triaxial cable connector adapter. The method includes providing an adapter housing with first and second ends. A first cable connector is selected having a first gender selected from a plurality of genders and a first style selected from a plurality of styles. The first cable connector is mounted the first cable connector to the first end of the adapter housing. A second cable connector is selected having a second gender selected from a plurality of genders and a second style selected from a plurality of styles. The second cable connector is mounted to the second end of the adapter housing.

BRIEF DESCRIPTION OF THE DRAWINGS

The accompanying drawings, which are incorporated in and constitute a part of the description, illustrate several aspects of the invention and together with the detailed description, serve to explain the principles of the invention. A brief description of the drawings is as follows.

DETAILED DESCRIPTION

Reference will now be made in detail to exemplary aspects of the present invention which are illustrated in the accompanying drawings. Wherever possible, the same reference numbers will be used throughout the drawings to refer to the same or like parts.

It is common for coaxial cables, such as triaxial cables, which are used to communicate electronic signals, to be terminated by a cable connector at one or both ends of the cable. To use these cables in the field or in the studio, a mating cable connector of the same style and opposite gender may be required. Typical genders are defined as male and female, while styles for such connectors include Global, U.S., BBC, and others. These styles are physically directly compatible with each other, meaning that a male Global style connector may not mate with a female U.S. connector. When such an incompatibility situation occurs, retermination of one or both of the cables or equipment to which the cable connectors may be a solution to electrically joining the two cables. Alternatively, fixed adapters may have been used which permit incompatible cable connectors to be mated. However, these known adapters are only be configured to mate with and join two distinct cable connectors. To ensure that joining of cables is possible without knowing the particular cable connectors, an entire array of cable connector adapters would be required to connect each known gender and style combination to each other known style and gender combination.

Figure 1:
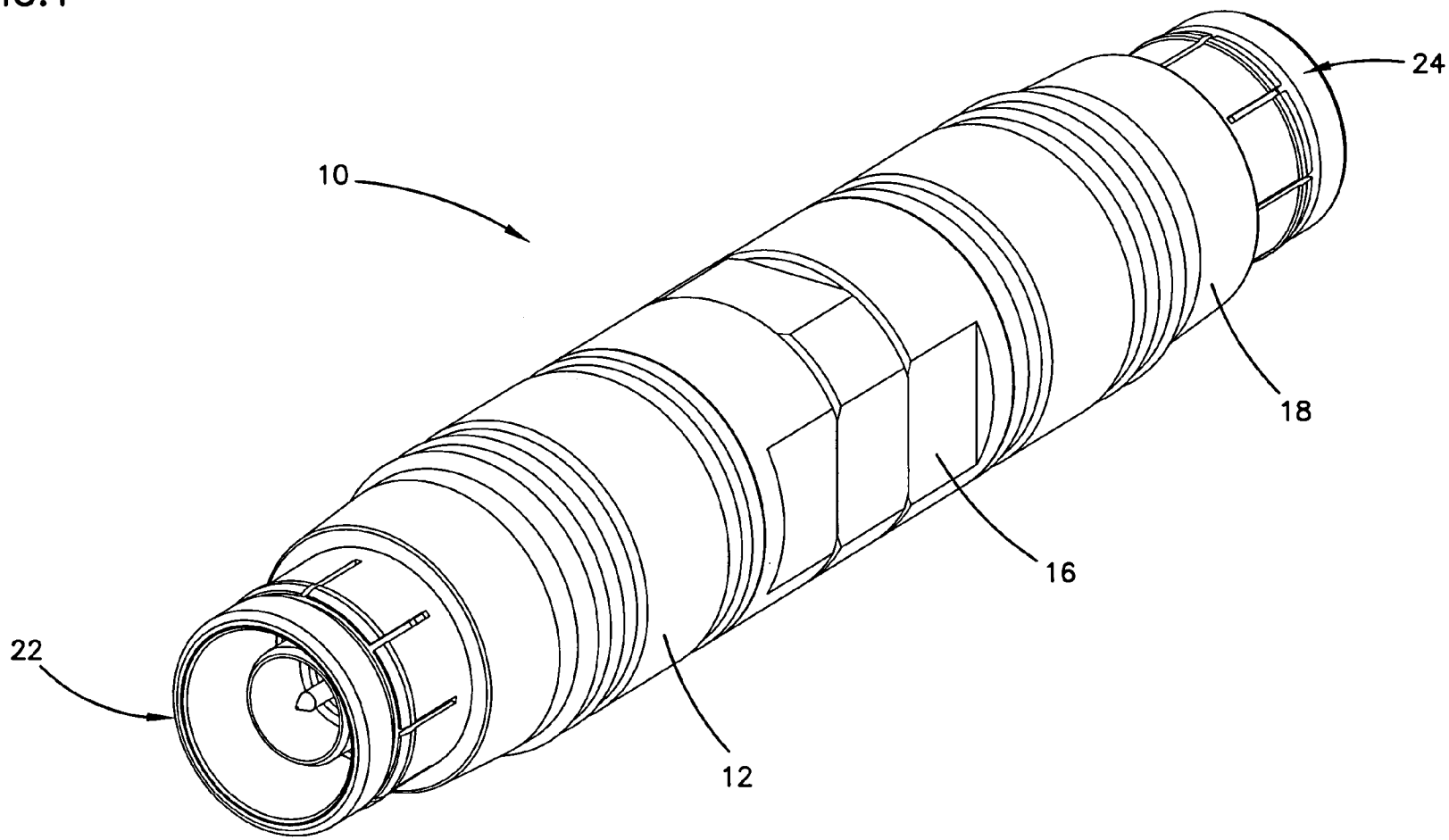
FIG. 1 is a perspective view of a triaxial cable connector adapter according to the present invention, with opposing male ends of a first format mounted.
Figure 5:
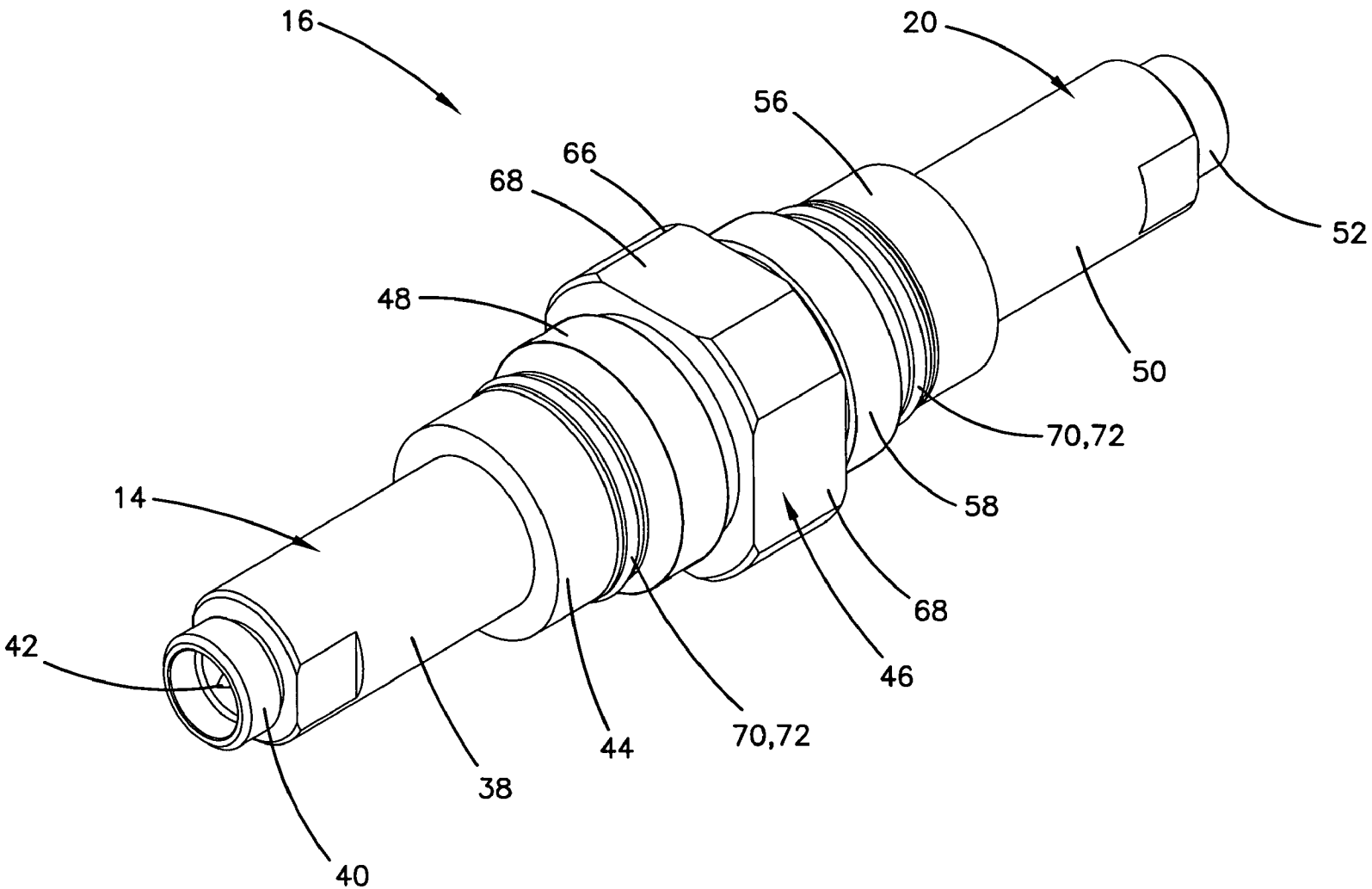
FIG. 5 is a perspective view of the universal adapter of triaxial cable connector adapter of FIG. 1.

FIG. 1 illustrates a triaxial cable connector assembly 10 with a first triaxial cable connector 12 mounted to a first end 14 of an adapter housing 16 and a second triaxial cable connector 18 mounted to a second end 20 of adapter housing 16. First and second ends 14 and 20 of adapter housing 16 are shown in FIG. 5, below. First cable connector 12 includes a mating end 22 for receiving a mating triaxial cable connector and second cable end 18 includes a mating end 24 for receiving a mating triaxial connector. As shown in FIG. 1, both mating end 22 and mating end 24 define a male connector end of a first style of triaxial connector. Additional triaxial cable connectors defining alternative genders and styles will be shown and described below. Each of these different triaxial cable connectors may be mounted to one of first end 14 or second end 20 of adapter housing 16.

Figure 2:
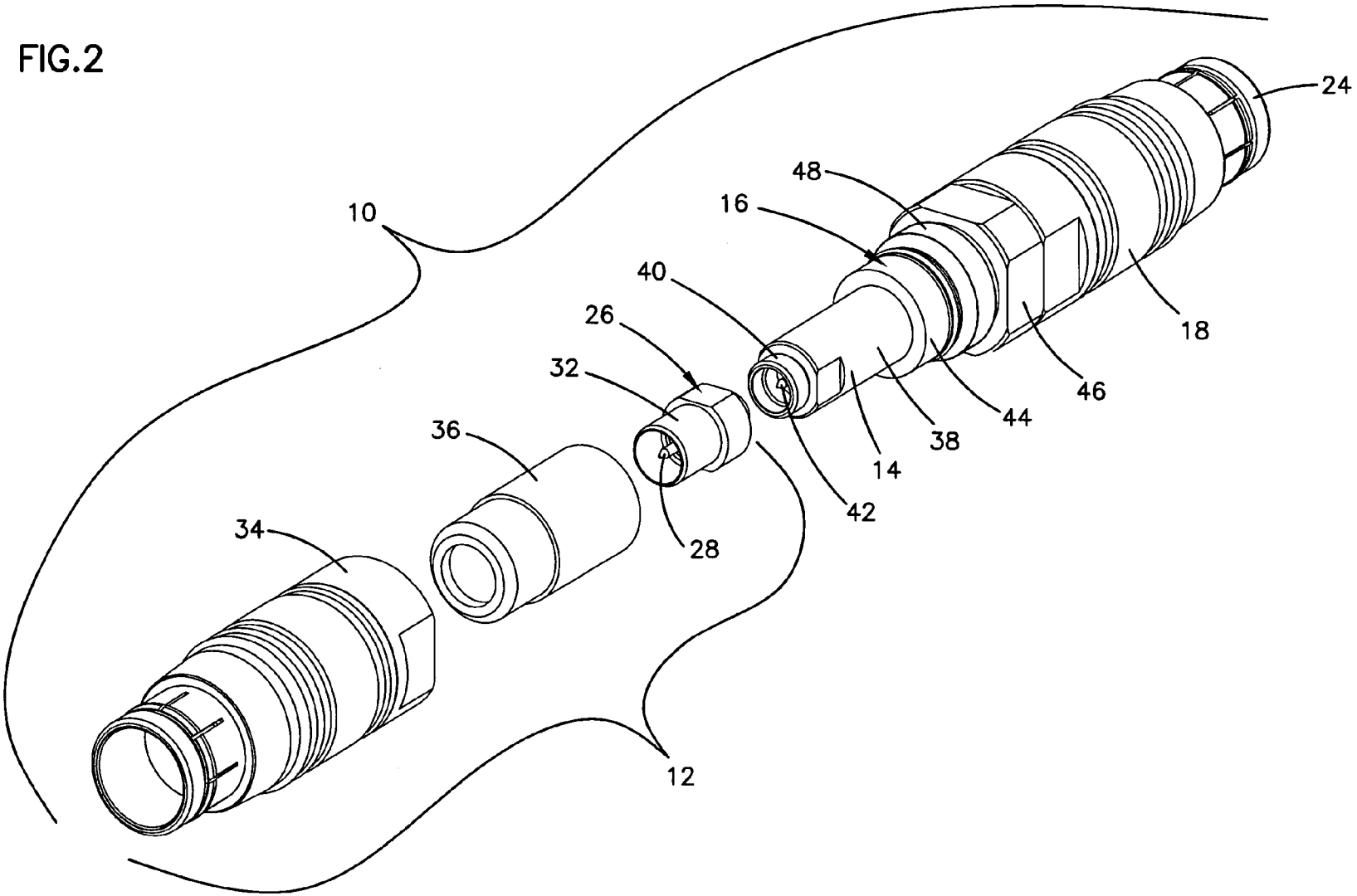
FIG. 2 is a perspective view of the triaxial cable connector adapter of FIG. 1, with the first end exploded.
Figure 3:
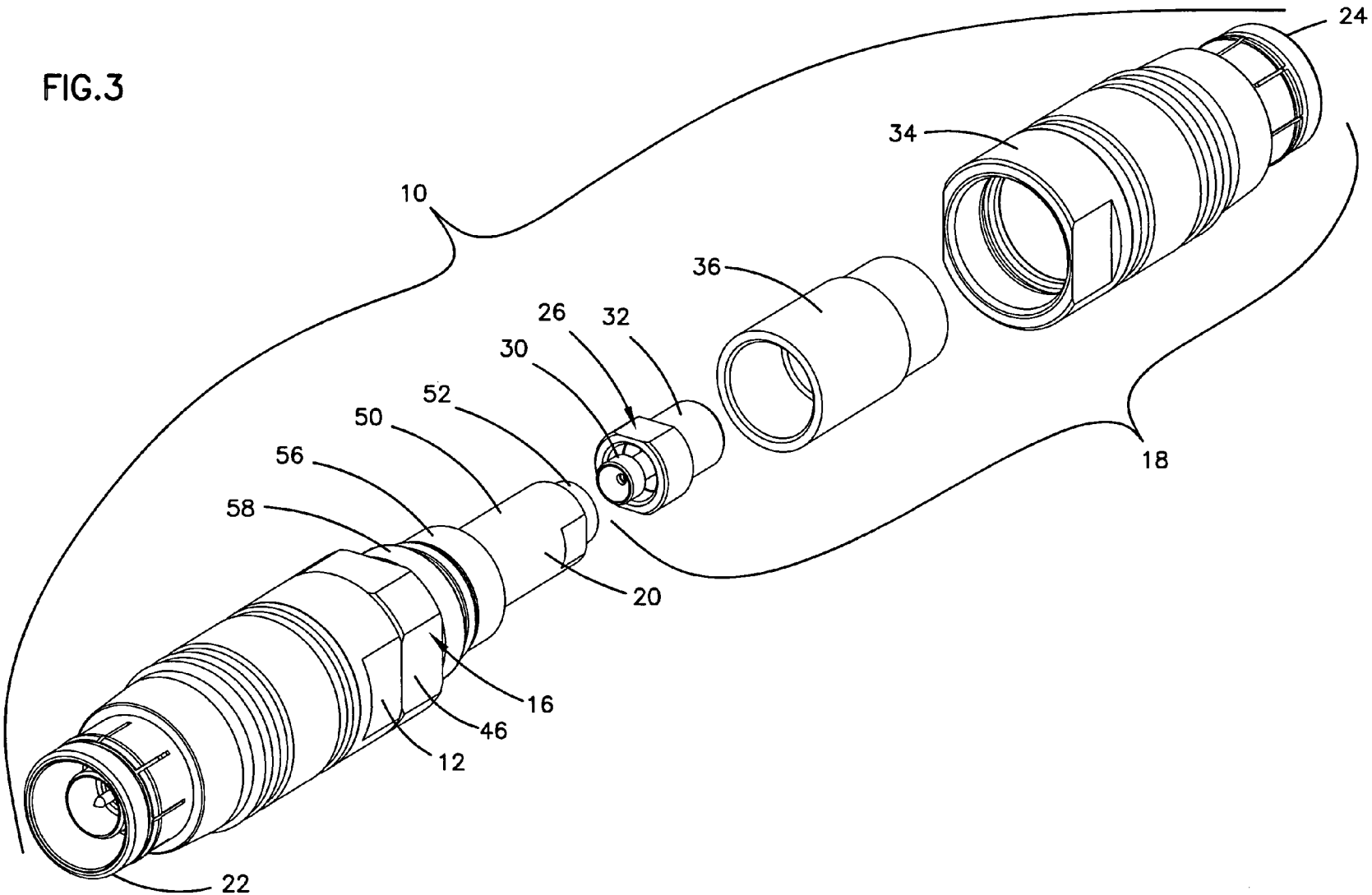
FIG. 3 is a perspective view of the triaxial cable connector adapter of FIG. 1, with the second end exploded.

Referring now to FIGS. 2 and 3, adapter 10 is shown with each of the cable connectors 12 and 18 in an exploded view. Each cable connector 12 and 18 includes a front shell assembly 26 with a center conductor 28, a center conductor insulator 30 and a front shell 32. Each cable connector 12 and 18 include an outer conductive body 34 which is mounted about and electrically isolated from front shell assembly 26 by an outer insulator 36. Additional details of these elements of the cable connectors may be found in U.S. Pat. Nos. 6,561,848 and 6,575,786, the disclosures of which are incorporated herein by reference.

As shown in FIG. 2, adapter 16 includes a first outer conductive shell 38 with an outer threaded portion 40 at first end 14. A first center conductor 42 is positioned within first outer conductive shell 38. First outer conductive shell 38 is mounted within an insulator 44 which is mounted within an adapter body 46. Adapter body 46 includes a threaded portion 48 toward first end 14. Adapter body 46 is electrically conductive and electrically isolated from first outer conductive shell 38 by insulator 44. Front shell assembly 26 of first cable connector 14 is mounted to adapter 16 by threading onto threaded portion 40. When front shell assembly 26 is mounted to adapter 16, center conductor 28 of first cable connector 14 is electrically connected with center conductor 42 of adapter 16 and front shell 32 is electrically connected to first outer conductive shell 38 of adapter 16. Outer conductive body 34 of first cable connector 14 is mounted to adapter 16 by threading onto threaded portion 48 of adapter body 46. When outer conductive body 34 is mounted to adapter 16, front outer body 34 is electrically connected to adapter body 46.

As shown in FIG. 3, adapter 16 includes a second outer conductive shell 50 with an outer threaded portion 52 at second end 20. A second center conductor 54 is positioned within second outer conductive shell 50 (shown in FIGS. 5 and 6, below). Second outer conductive shell 50 is mounted within an insulator 56 which is mounted within adapter body 46. Adapter body 46 includes a threaded portion 58 toward second end 18. Adapter body 46 is electrically conductive and electrically isolated from second outer conductive shell 50 by insulator 56. Front shell assembly 26 of second cable connector 18 is mounted to adapter 16 by threading onto threaded portion 52. When front shell assembly 26 is mounted to adapter 16, center conductor 28 of second cable connector 18 is electrically connected with center conductor 54 of adapter 16 and front shell 32 is electrically connected to second outer conductive shell 50 of adapter 16. Outer conductive body 34 of second cable connector 18 is mounted to adapter 16 by threading onto threaded portion 58 of adapter body 46. When outer conductive body 34 is mounted to adapter 16, front outer body 34 is electrically connected to adapter body 46.

Figure 4:
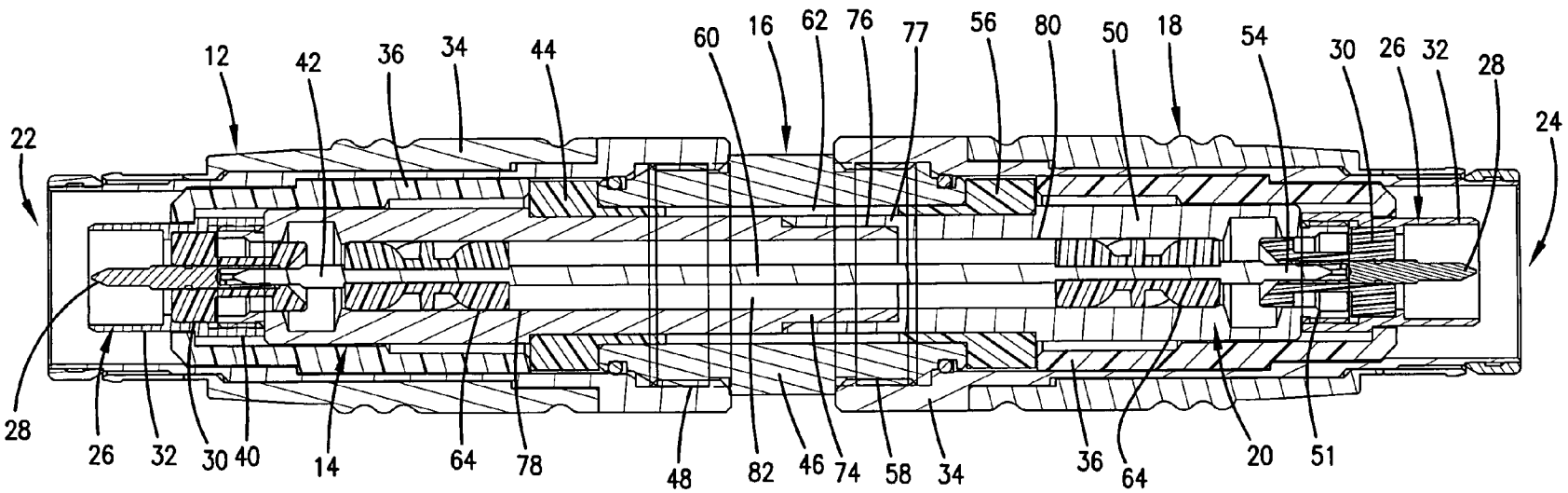
FIG. 4 is a side cross-sectional view of the triaxial cable connector adapter of FIG. 1.

When assembled as shown in FIGS. 1 and 4, adapter 10 provides electrical continuity between center conductors 28 of first cable connector 14 and second cable connector 18. This continuity is provided by a central shaft 60 connected center conductors 42 and 54. Adapter 10 also provides electrical continuity between front shell 32 of first cable connector 14 and second cable connector 18. This continuity is provided by the connection of first conductive outer shell 38 and second conductive outer shell 50 within an opening 62 extending through adapter body 46. Central shaft 60 also extends through opening 62 through outer conductive shells 38 and 50, which are hollow. Central shaft 60 and center conductors 42 and 54 are electrically isolated from outer conductive shells 38 and 50 by two pairs of adapter center conductor insulators halves 64. Adapter 10 further provides electrical continuity between conductive outer bodies 34 of first cable connector 14 and second cable connector 18. This continuity is provided through adapter body 46, which is preferably constructed of an electrically conductive material.

Referring now to FIG. 5, adapter body 46 includes a center section 66 midway between the first and second ends 14 and 20. Center section 66 includes a plurality of opposing wrench flats 68 to aid is assembly and disassembly of adapter 16 into cable connector assembly 10.

Figure 6:
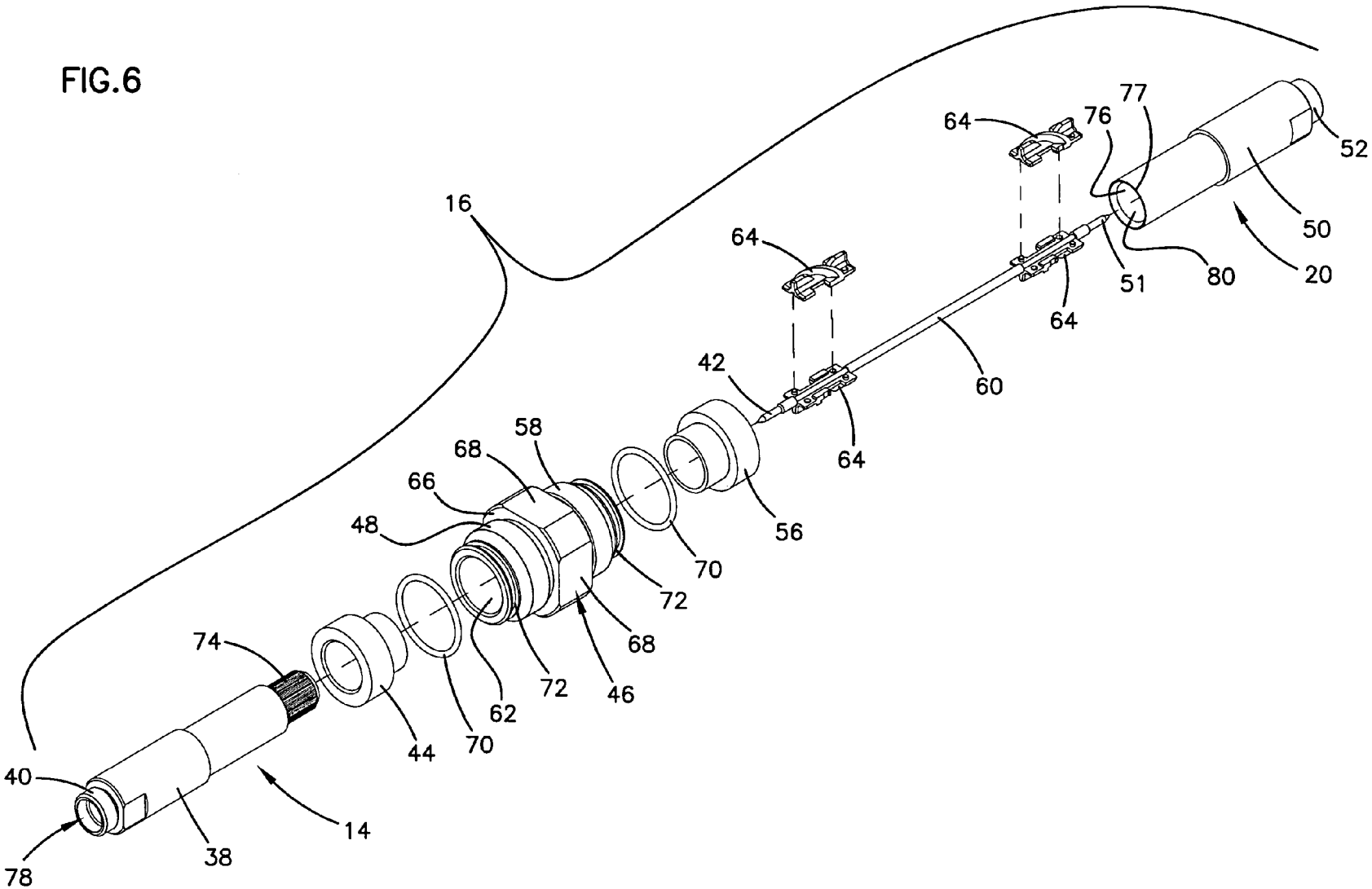
FIG. 6 is an exploded perspective view of the triaxial cable connector universal adapter of FIG. 5.
Figure 7:
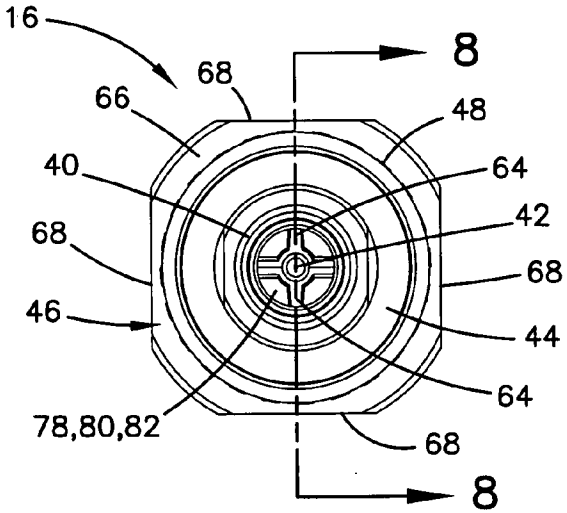
FIG. 7 is an end view of the triaxial cable connector universal adapter of FIG. 5.
Figure 8:
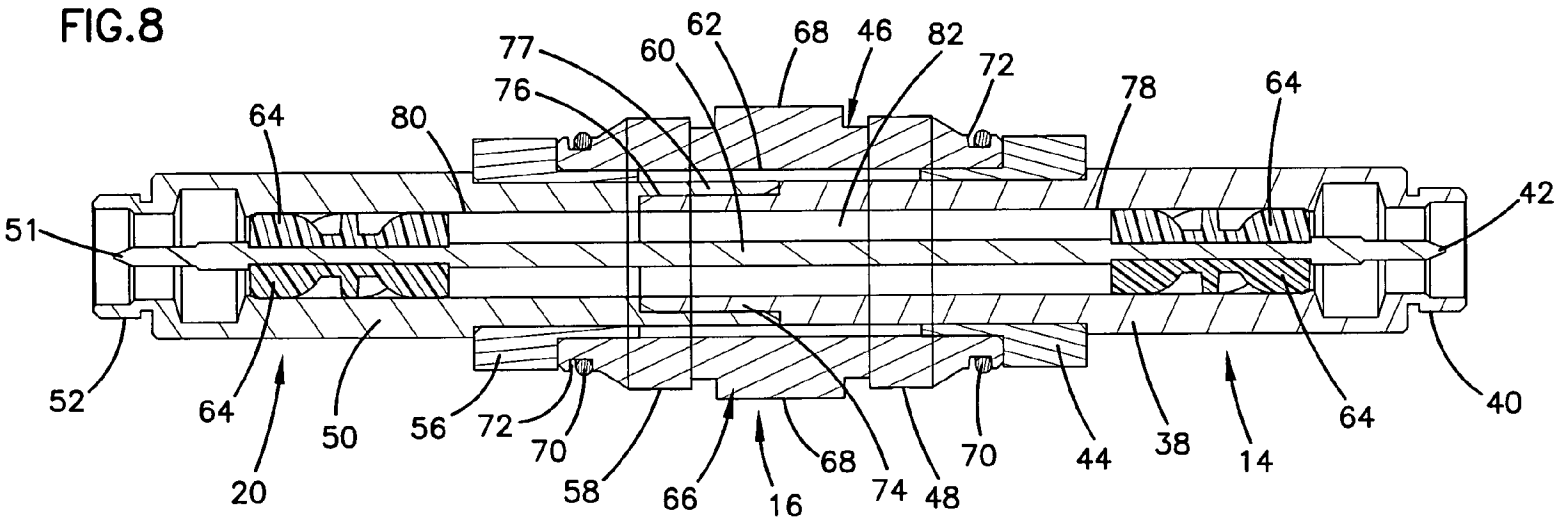
FIG. 8 is a side cross-sectional view of the triaxial cable connector universal adapter, taken along line 8—8 in FIG. 7.

Referring now to FIGS. 6, 7 and 8, adapter 16 may also includes a pair of O-rings 70 which are positioned within a groove 72 adjacent each of the threaded portions 48 and 58 of adapter body 46. First outer conductive shell 38 includes a narrow inner end 74 which is sized to be received within an enlarged opening 76 in an inner end 77 of second conductive outer shell 50. Preferably, a friction or press fit holds the two conductive outer shells together. First conductive outer shell 34 defines a central longitudinal opening 78 and second conductive outer shell 50 defines a central longitudinal opening 80. Central longitudinal openings 78 and 80 cooperate to form an opening 82 through adapter 16 within which are positioned center conductors 42 and 51, center conductor insulators 64 and shaft 60.

Figure 9:
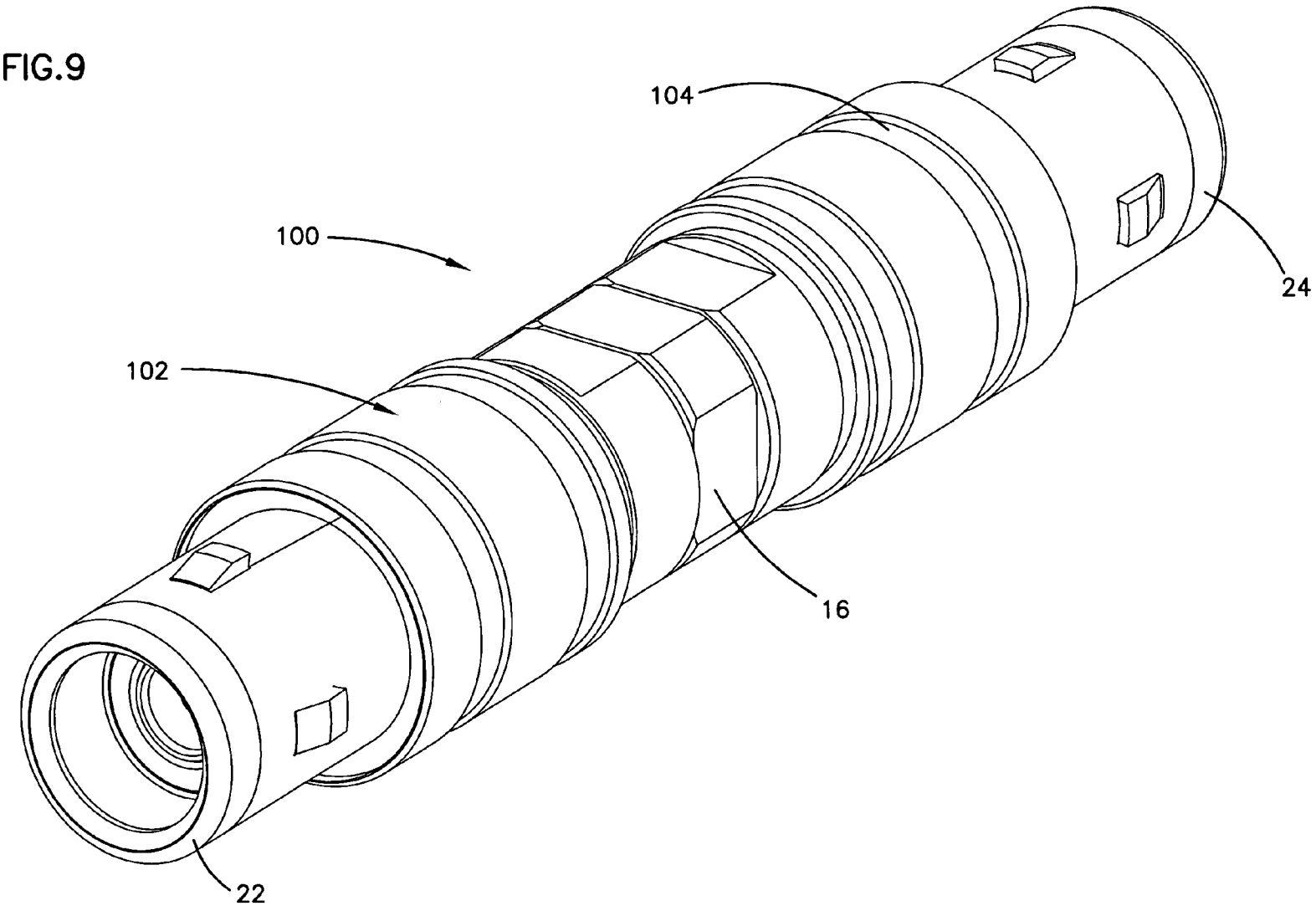
FIG. 9 is a perspective view of the triaxial cable connector universal adapter of FIG. 5, with opposing male ends of a second format mounted.
Figure 10:
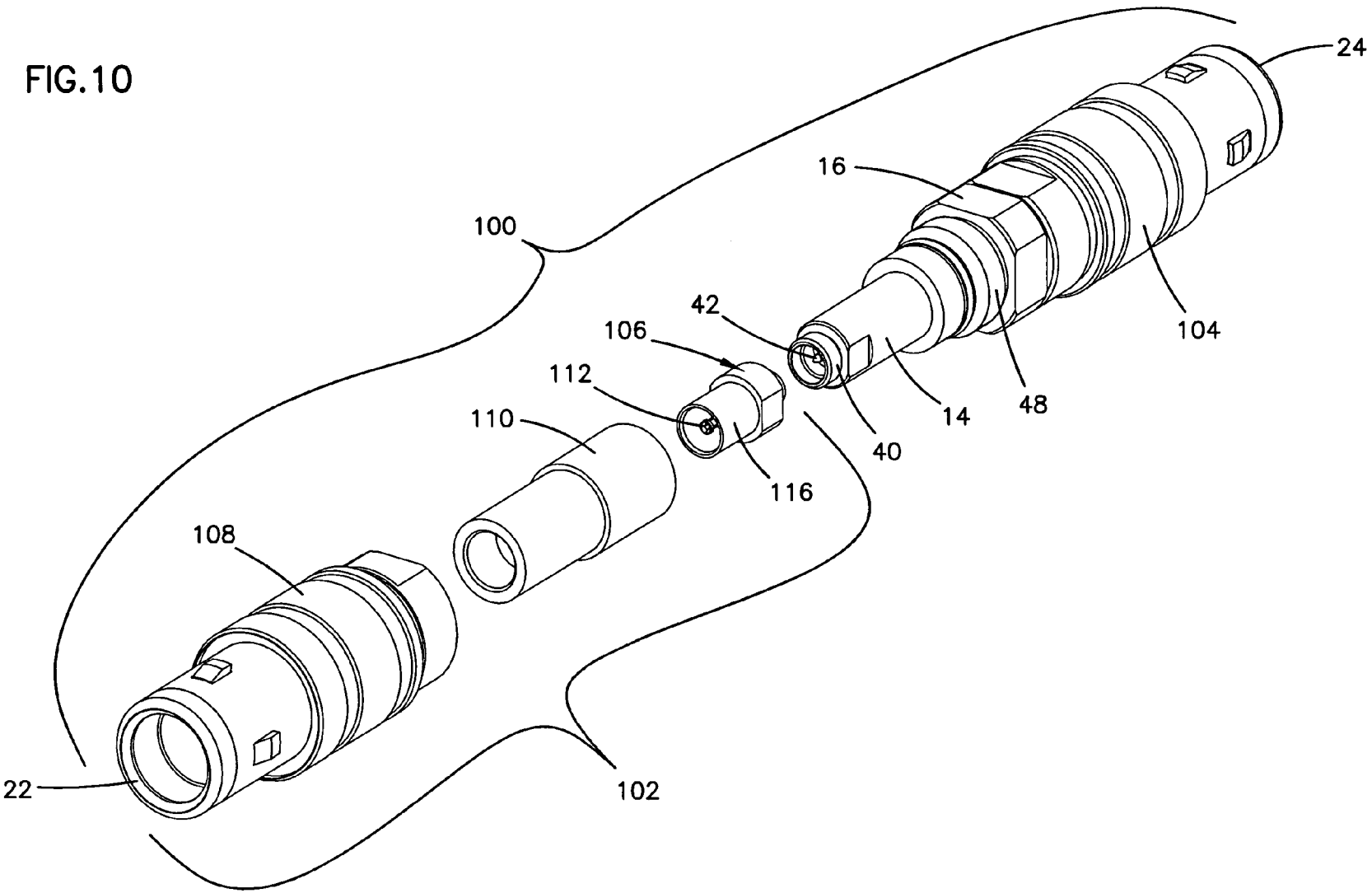
FIG. 10 is a perspective view of the triaxial cable connector adapter of FIG. 9, with the first end exploded.
Figure 11:
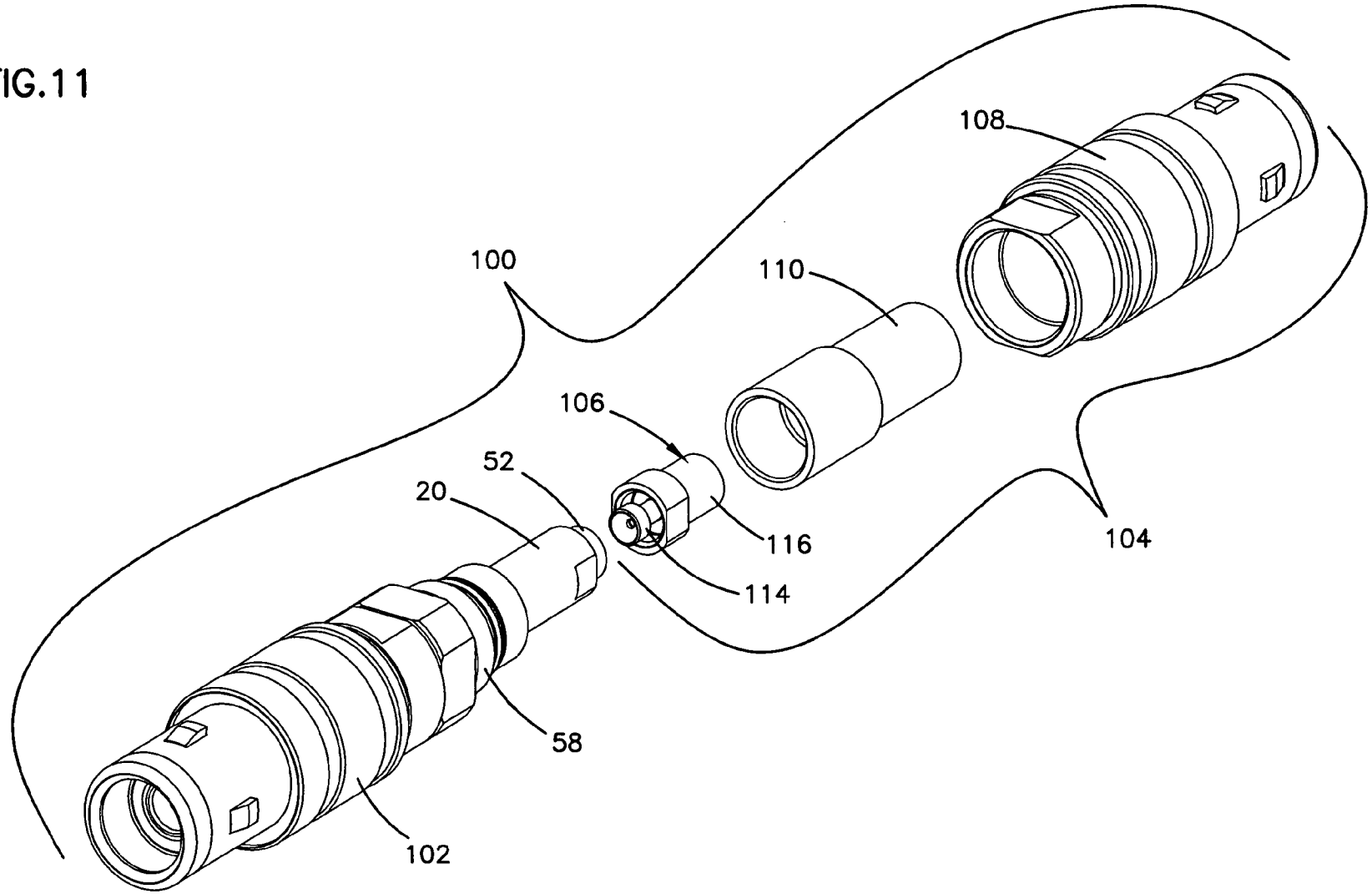
FIG. 11 is a perspective view of the triaxial cable connector adapter of FIG. 9, with the second end exploded.

FIGS. 1 to 8 show adapter 16 with a particular style and gender of cable connectors 12 and 18 mounted to first end 14 and second end 20, respectively. As shown, cable connectors 12 and 18 define male Global style connectors. A variety of other styles and genders of cable connectors may be used with the same adapter 16. A first alternative cable connector assembly 100 is shown in FIGS. 9 to 11, where a first cable connector 102 defines a male U.S. style connector with first mating end 22. A second cable connector 104 defines a male U.S. style connector with second mating end 24. Cable connectors 102 and 104 are mounted about first end 14 and second end 18, respectively, of adapter 16.

Cable connector 102 includes a front shell assembly 106 mounted threaded portion 40 of adapter 16, and a conductive outer body 108 mounted to threaded portion 48 of adapter 16. Front shell assembly 106 includes a center conductor 112 positioned within an inner insulator 114 which is in turn positioned within a front shell 116. Center conductor 112 is connected to center conductor 42 of adapter 16 and electrically isolated from front shell 116 by inner insulator 114. An outer insulator 110 is positioned between and electrically isolates front shell assembly 106 and conductive outer body 108. Cable connector 104 also includes front shell assembly 106 mounted threaded portion 52 of adapter 16, and conductive outer body 108 mounted to threaded portion 58 of adapter 16. Center conductor 112 of cable connector 104 is connected with center conductor 51 of adapter 16. Cable connector 104 also includes outer insulator 110 positioned between and electrically isolates front shell assembly 106 and conductive outer body 108.

The electrical connectivity within cable connector assembly 100 between conductive outer shells 108, the front shells 116 and center conductors 112 of cable connectors 102 and 104 is similar to that described above with regard to cable connector assembly 10. Ends 22 and 24 are configured to mate with different style and gender triaxial cable connectors, otherwise cable connector assemblies 10 and 100 are functional identical.

Figure 12:
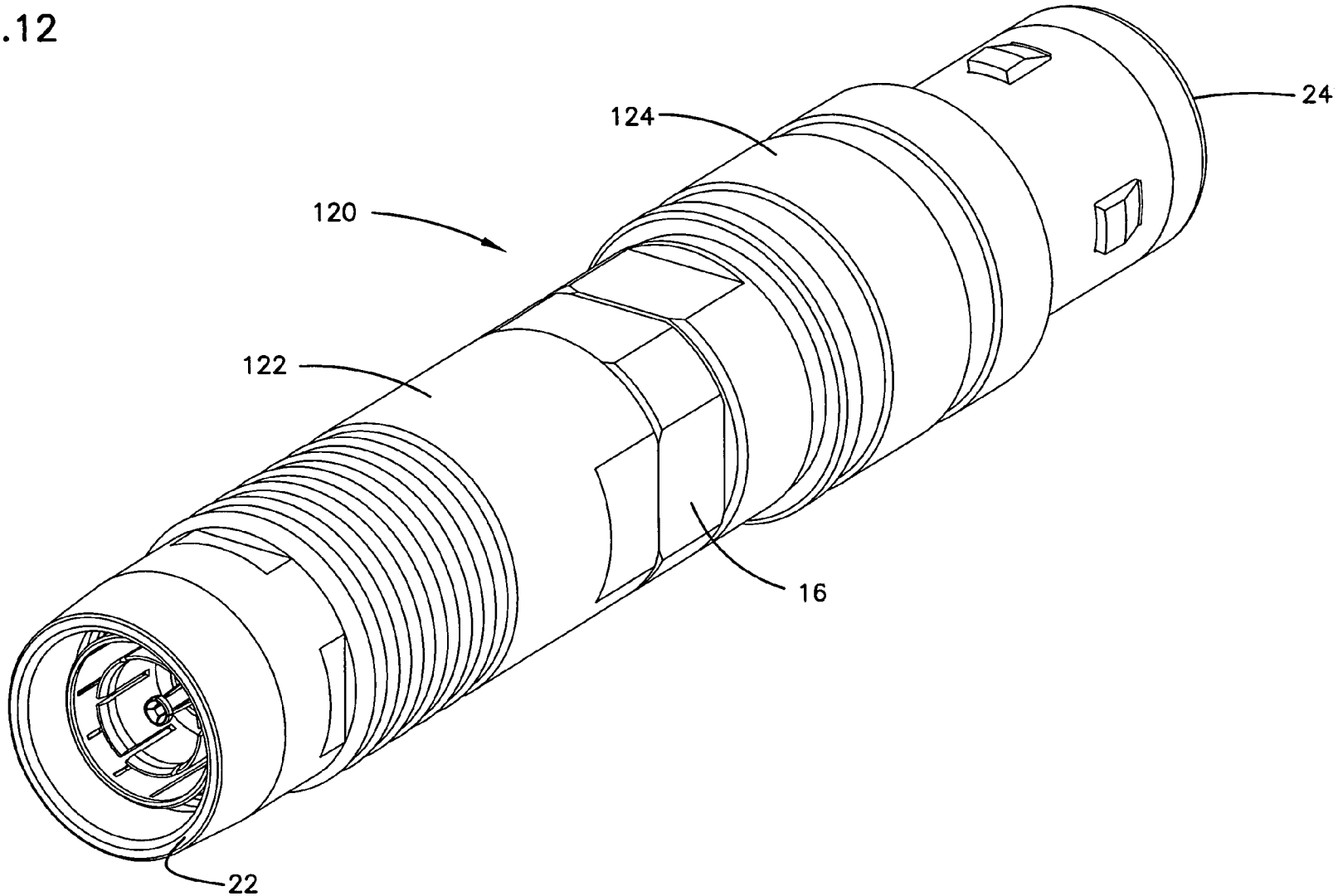
FIG. 12 is a perspective view of the triaxial cable connector universal adapter of FIG. 5, with a first female end of the first format and an opposing male second end of the second format mounted.
Figure 13:
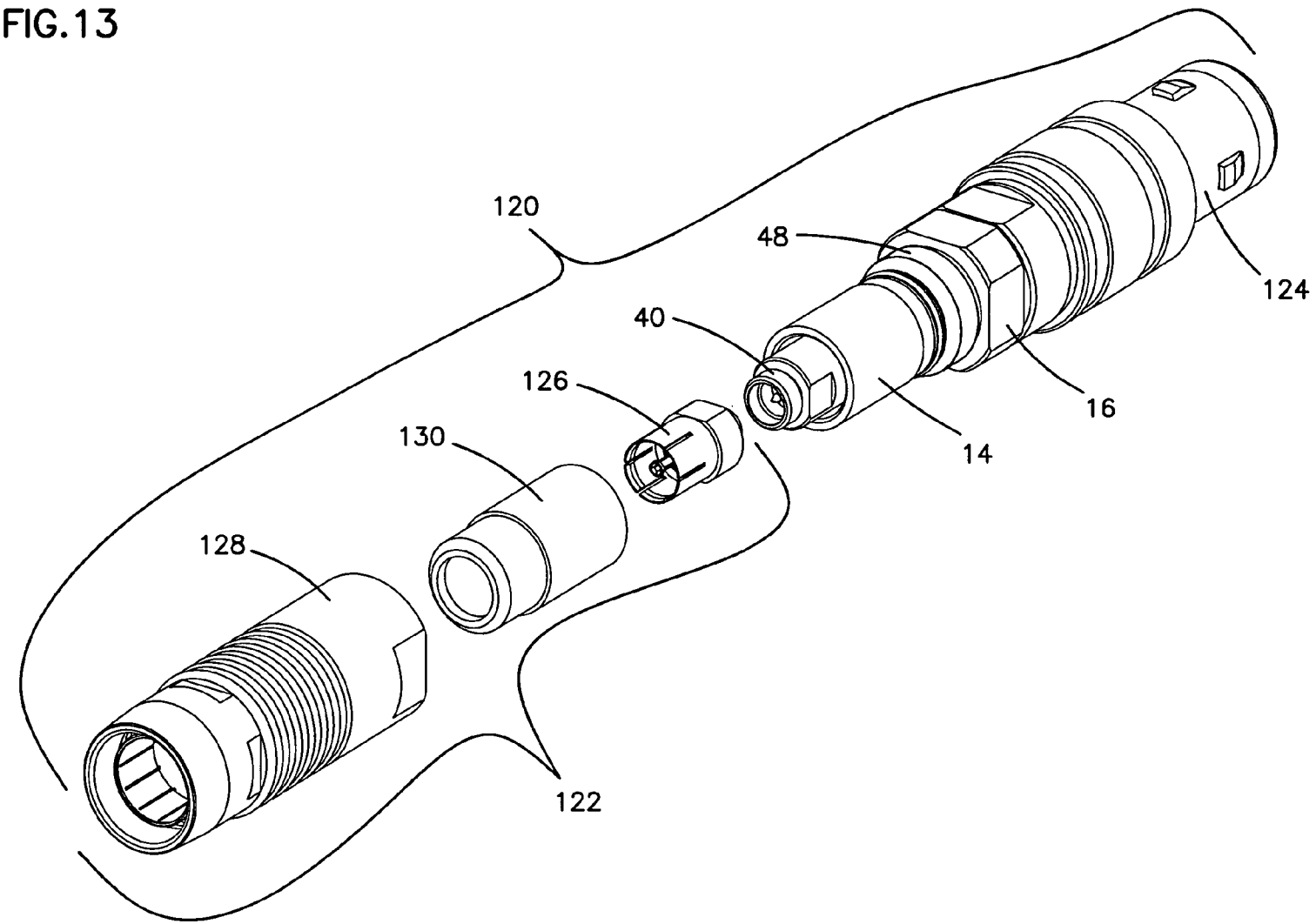
FIG. 13 is a perspective view of the triaxial cable connector adapter of FIG. 12, with the first end exploded.
Figure 14:
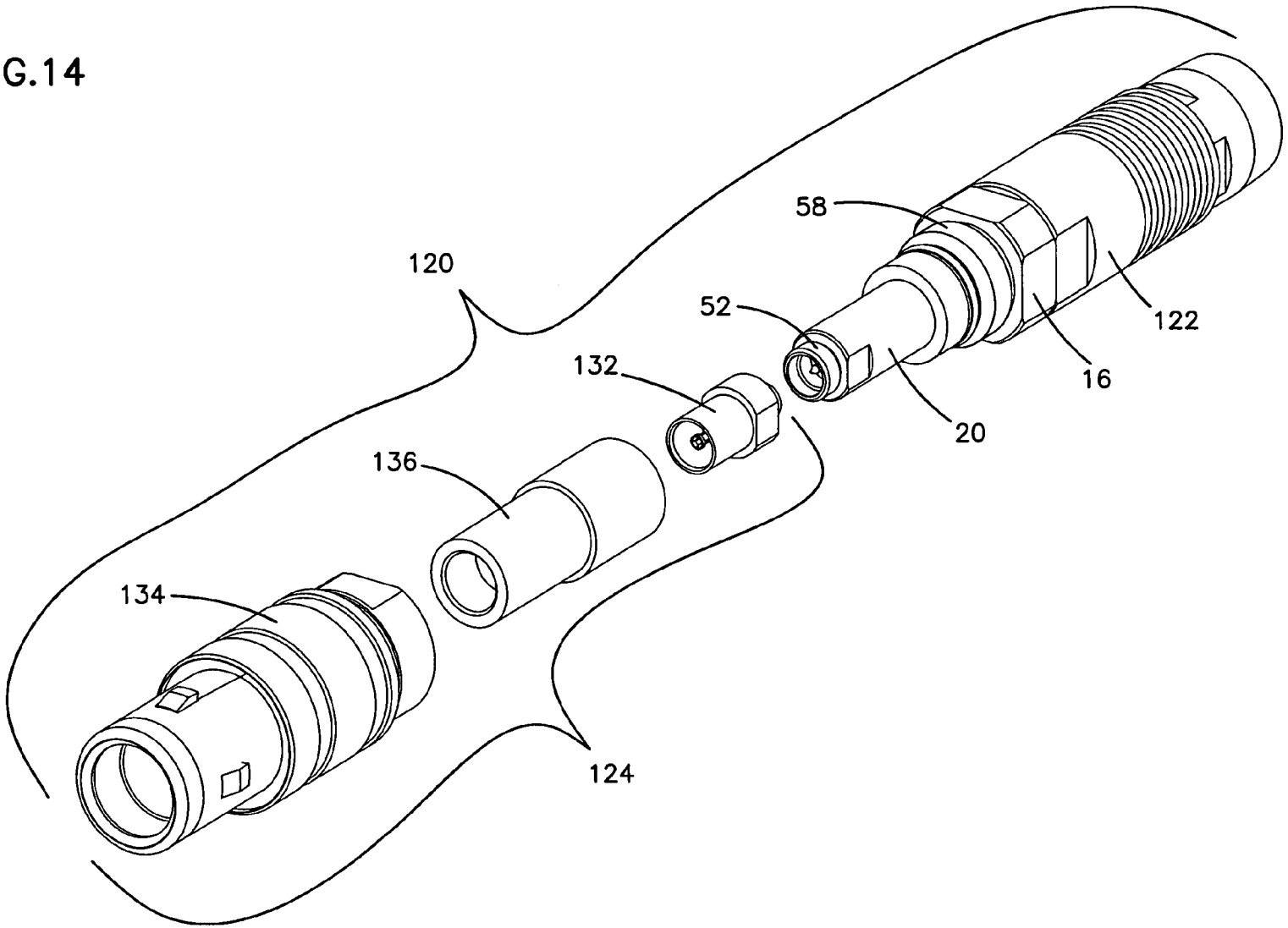
FIG. 14 is a second perspective view of the triaxial cable connector adapter of FIG. 12, with the second end exploded.

FIGS. 12 to 14 show a second alternative embodiment cable connector assembly 120 with an adapter 16, a first cable connector 122 and a second cable connector 124. First cable connector 122 of cable connector assembly 120 defines a female Global style connector with first mating end 22. Second cable connector 124 defines a male U.S. style connector with second mating end 24. First cable connector 122 includes a front shell assembly 126 mounted to threaded portion 40 of adapter 16 and an outer conductive body 128 mounted to threaded portion 48 of adapter 16, about first end 14. An outer insulator 130 is positioned between and electrically isolates front shell assembly 126 and outer conductive body 128.

Second cable connector 124 includes a front shell assembly 132 mounted to threaded portion 52 of adapter 16 and an outer conductive body 134 mounted to threaded portion 58 of adapter 16, about second end 20. An outer insulator 136 is positioned between and electrically isolates front shell assembly 132 and outer conductive body 134. The electrical connectivity between front shell assemblies 126 and 132, and outer conductive bodies 128 and 134 is similar to that described above with to cable connector assembly 10. Ends 22 and 24 are configured to mate with different style and gender triaxial cable connectors, otherwise cable connector assemblies 10 and 120 are functional identical.

Figure 15:
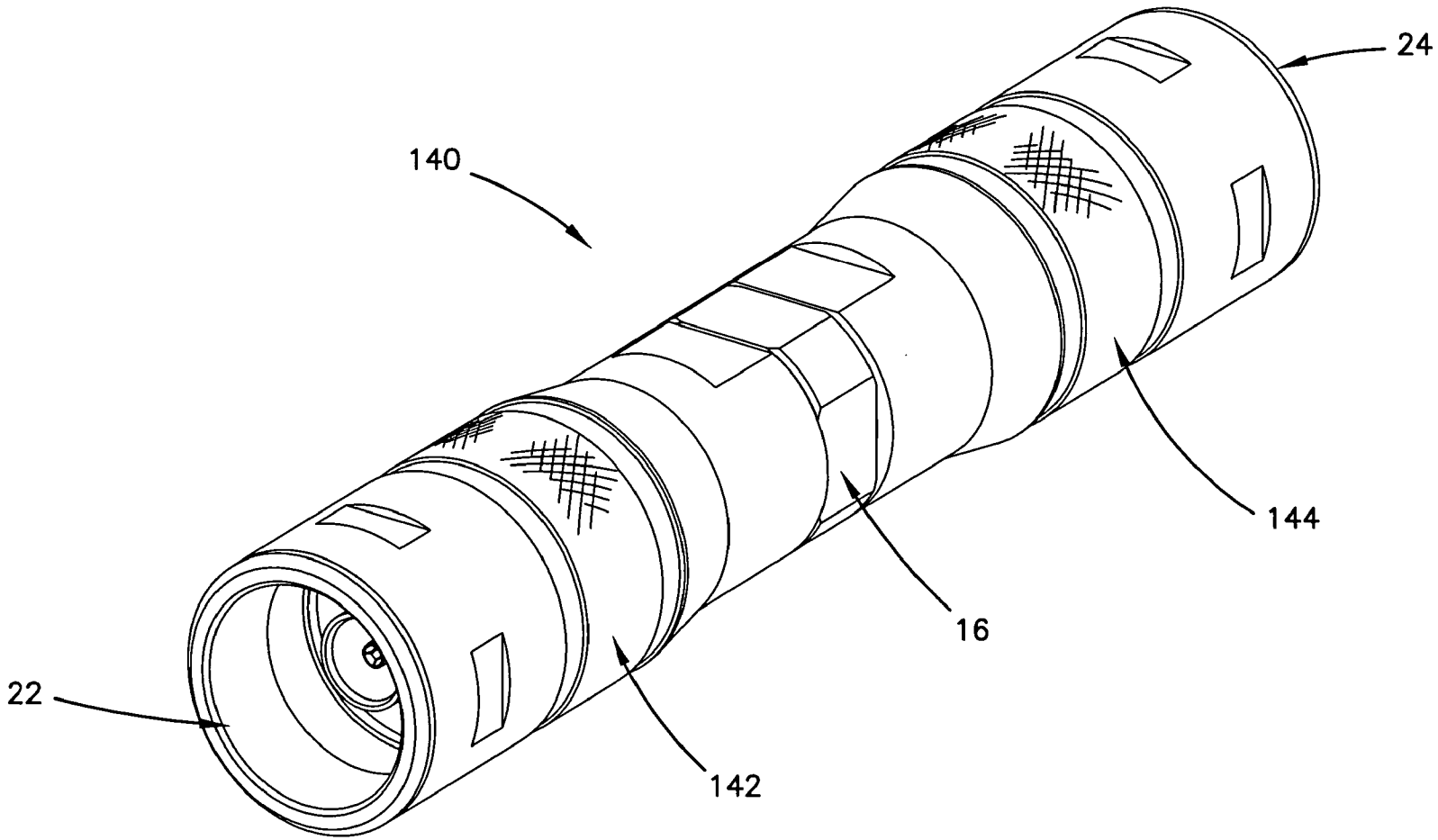
FIG. 15 is a perspective view of the triaxial cable connector adapter of FIG. 5, with opposing female ends of the second format mounted.
Figure 16:
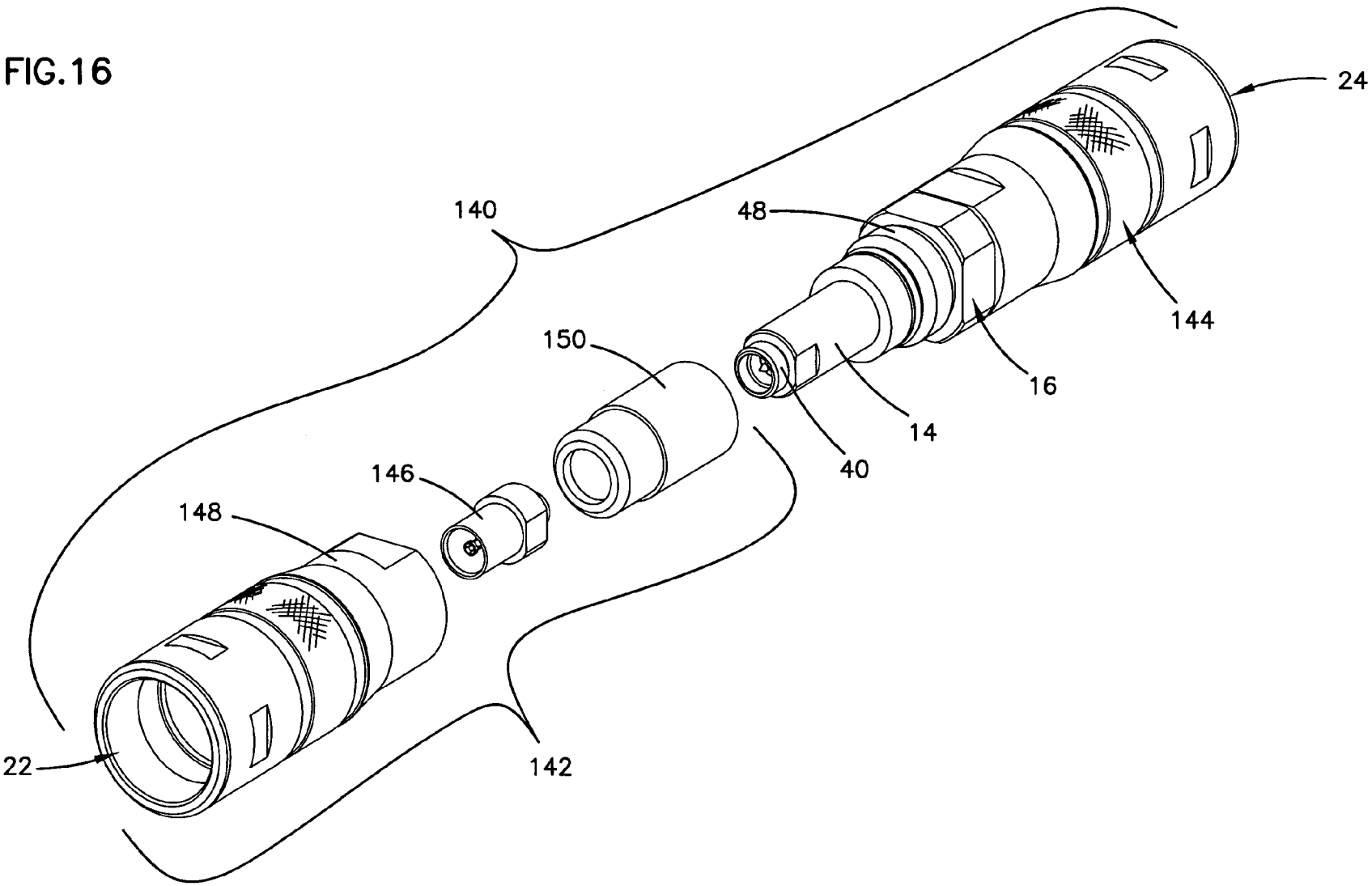
FIG. 16 is a perspective view of the triaxial cable connector adapter of FIG. 15, with the first end exploded.
Figure 17:
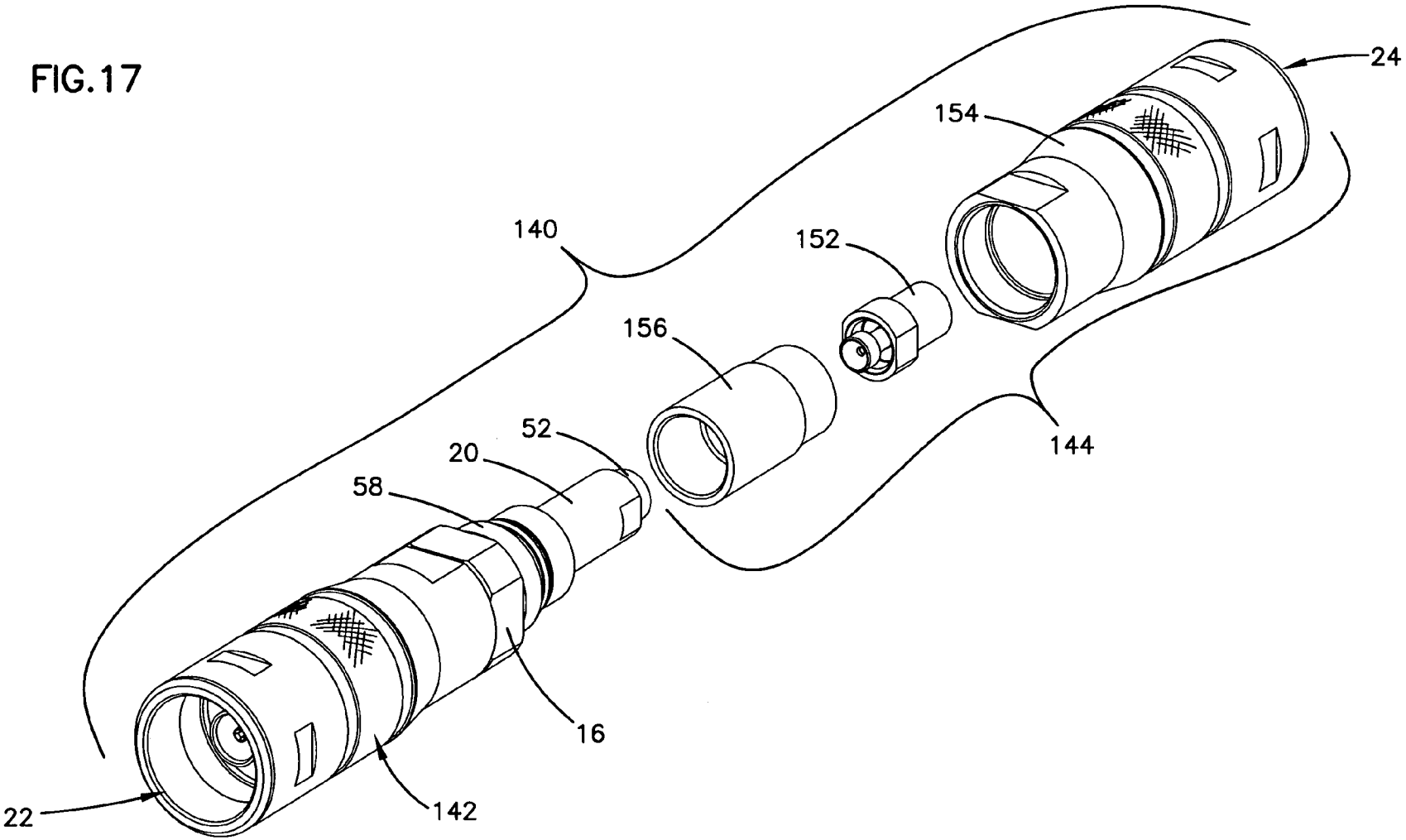
FIG. 17 is a second perspective view of the triaxial cable connector adapter of FIG. 15, with the second end exploded.

FIGS. 15 to 17 show a third alternative embodiment cable connector assembly 140 with an adapter 16, a first cable connector 142 and a second cable connector 144. First cable connector 142 of cable connector assembly 140 defines a female U.S. style connector with first mating end 22. Second cable connector 144 defines a female U.S. style connector with second mating end 24. First cable connector 142 includes a front shell assembly 146 mounted to threaded portion 40 of adapter 16 and an outer conductive body 148 mounted to threaded portion 48 of adapter 16, about first end 14. An outer insulator 150 is positioned between and electrically isolates front shell assembly 146 and outer conductive body 148.

Second cable connector 144 includes a front shell assembly 152 mounted to threaded portion 52 of adapter 16 and an outer conductive body 154 mounted to threaded portion 58 of adapter 16, about second end 20. An outer insulator 156 is positioned between and electrically isolates front shell assembly 152 and outer conductive body 154. The electrical connectivity between front shell assemblies 146 and 152, and outer conductive bodies 148 and 154 is similar to that described above with to cable connector assembly 10. Ends 22 and 24 are configured to mate with different style and gender triaxial cable connectors, otherwise cable connector assemblies 10 and 140 are functional identical.

Figure 18:
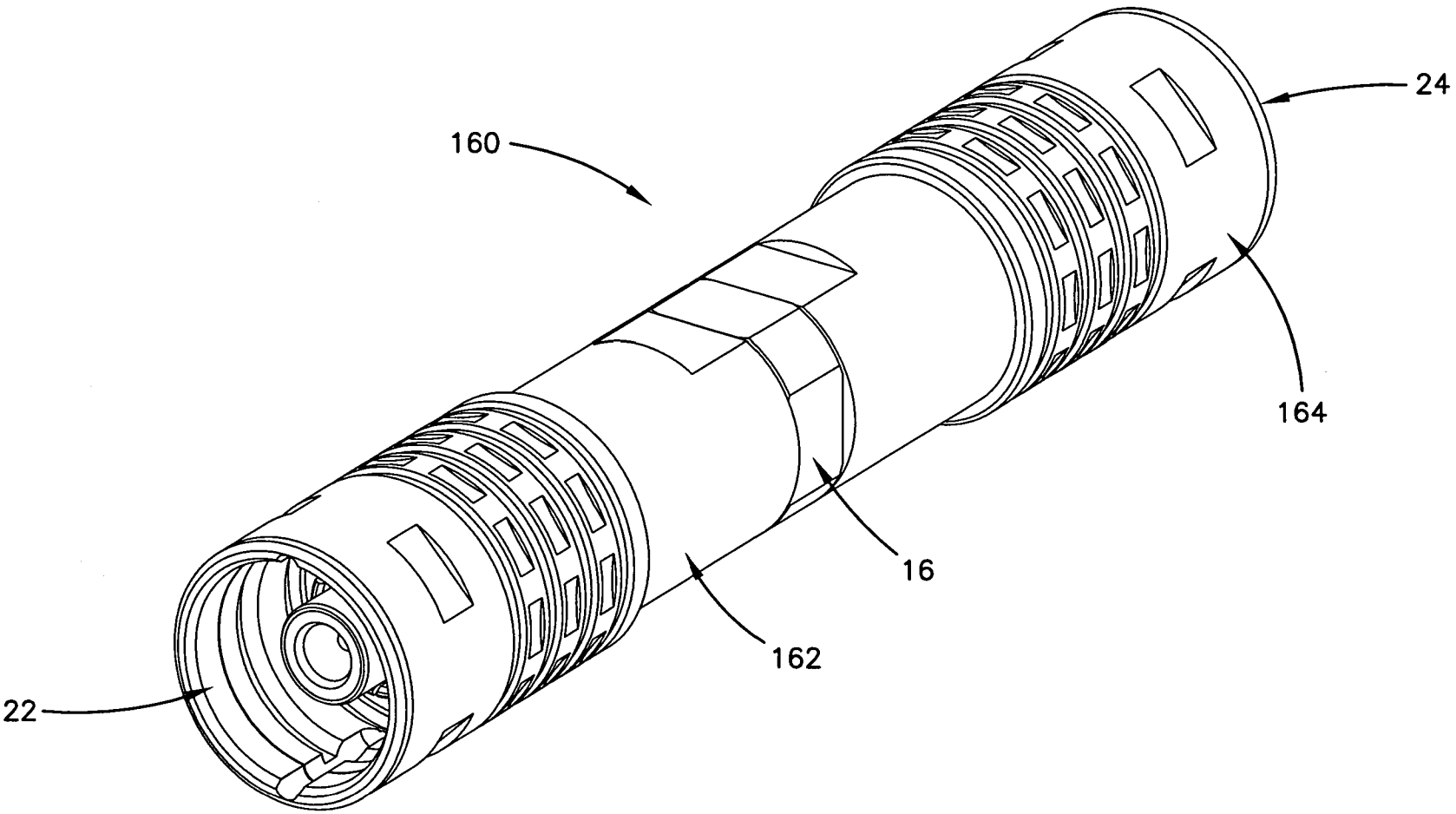
FIG. 18 is a perspective view of the triaxial cable connector adapter of FIG. 5, with opposing male ends of the third format mounted.
Figure 19:
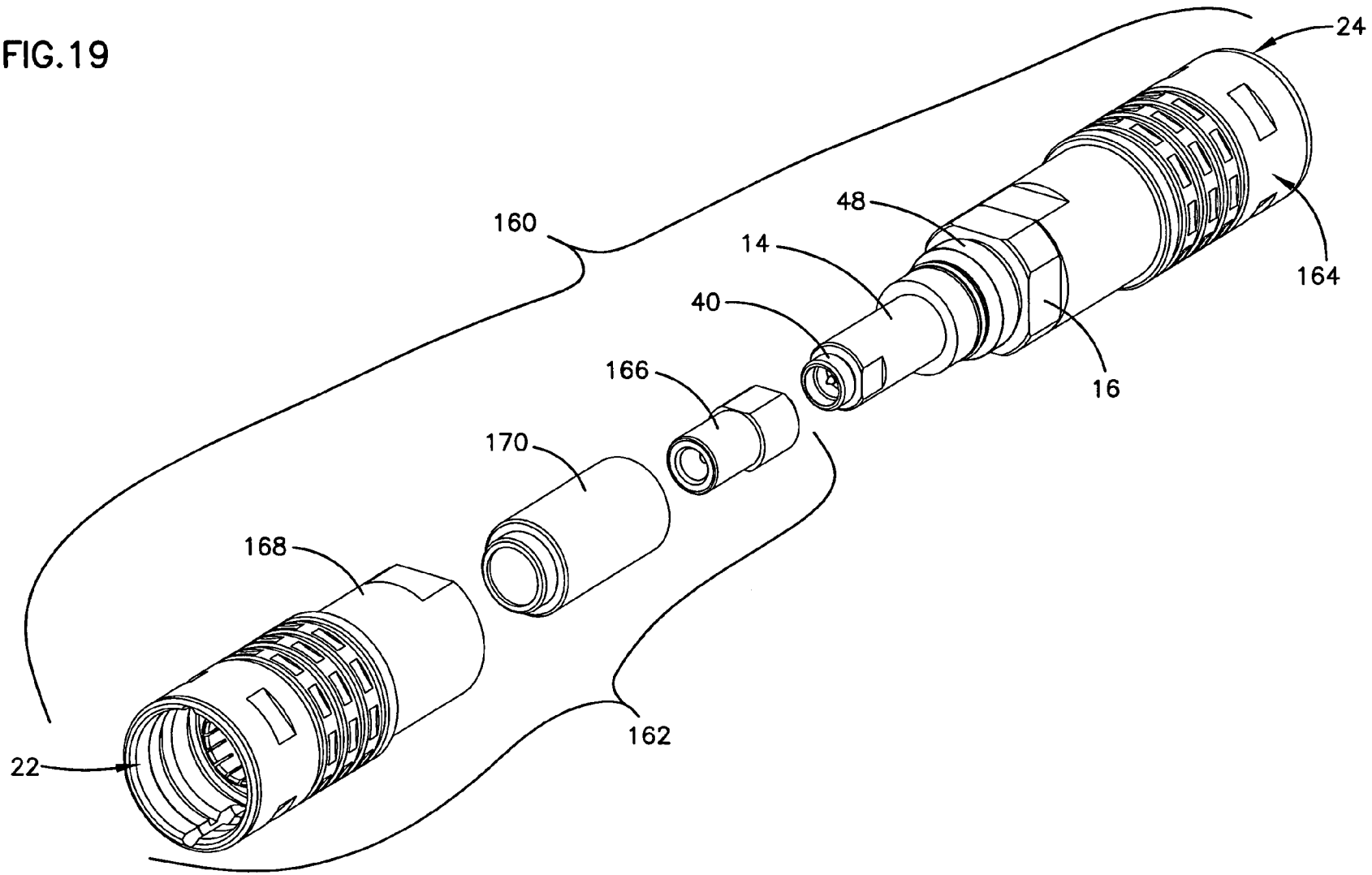
FIG. 19 is a perspective view of the triaxial cable connector adapter of FIG. 18, with the first end exploded.
Figure 20:
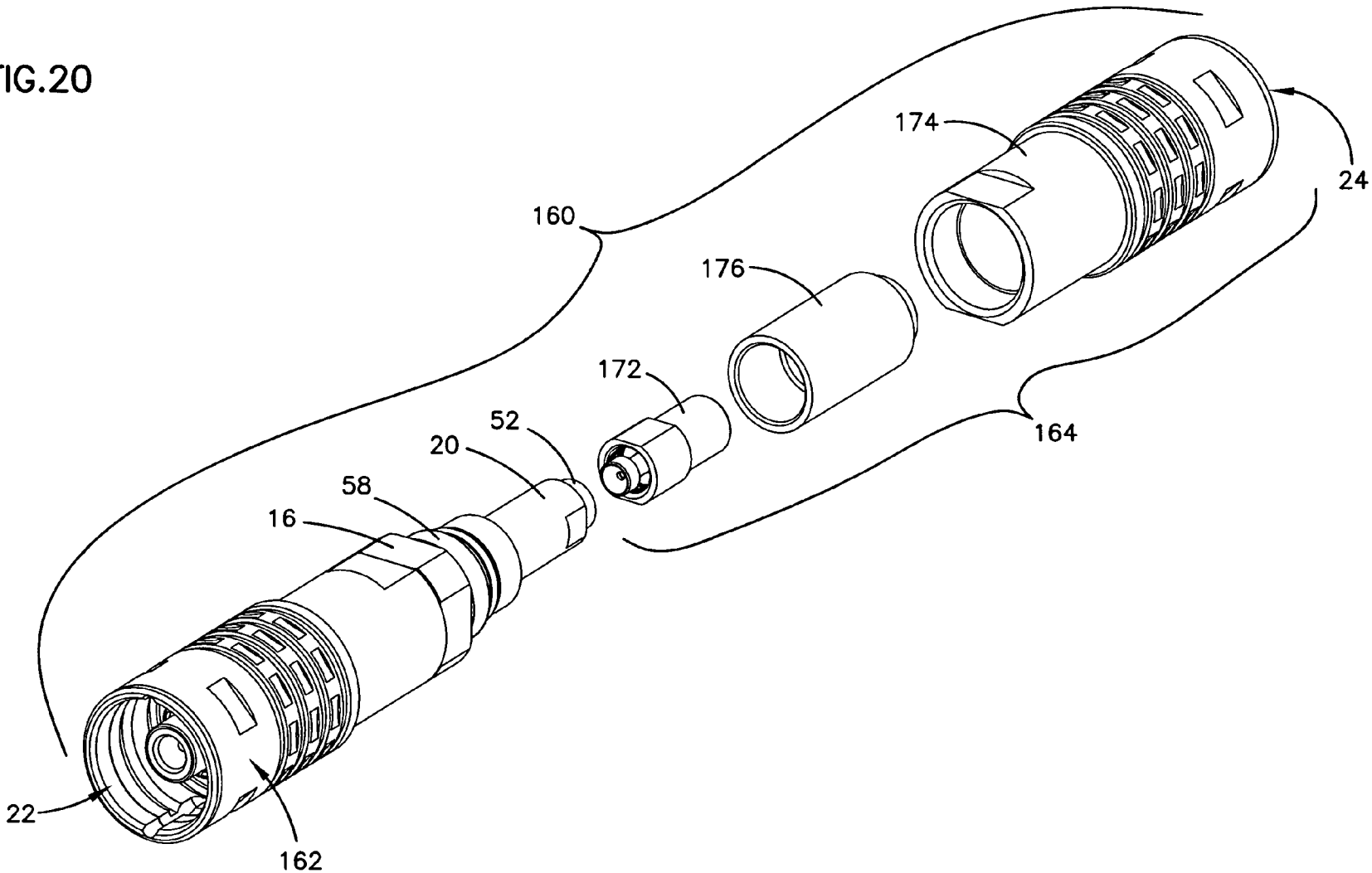
FIG. 20 is a perspective view of the triaxial cable connector adapter of FIG. 18, with the second end exploded.

FIGS. 18 to 20 show a fourth alternative embodiment cable connector assembly 160 with an adapter 16, a first cable connector 162 and a second cable connector 164. First cable connector 162 of cable connector assembly 160 defines a male BBC style connector with first mating end 22. Second cable connector 164 defines a male BBC style connector with second mating end 24. First cable connector 162 includes a front shell assembly 166 mounted to threaded portion 40 of adapter 16 and an outer conductive body 168 mounted to threaded portion 48 of adapter 16, about first end 14. An outer insulator 170 is positioned between and electrically isolates front shell assembly 166 and outer conductive body 168.

Second cable connector 164 includes a front shell assembly 172 mounted to threaded portion 52 of adapter 16 and an outer conductive body 174 mounted to threaded portion 58 of adapter 16, about second end 20. An outer insulator 176 is positioned between and electrically isolates front shell assembly 172 and outer conductive body 174. The electrical connectivity between front shell assemblies 166 and 172, and outer conductive bodies 168 and 174 is similar to that described above with to cable connector assembly 10. Ends 22 and 24 are configured to mate with different style and gender triaxial cable connectors, otherwise cable connector assemblies 10 and 160 are functional identical.

Figure 21:
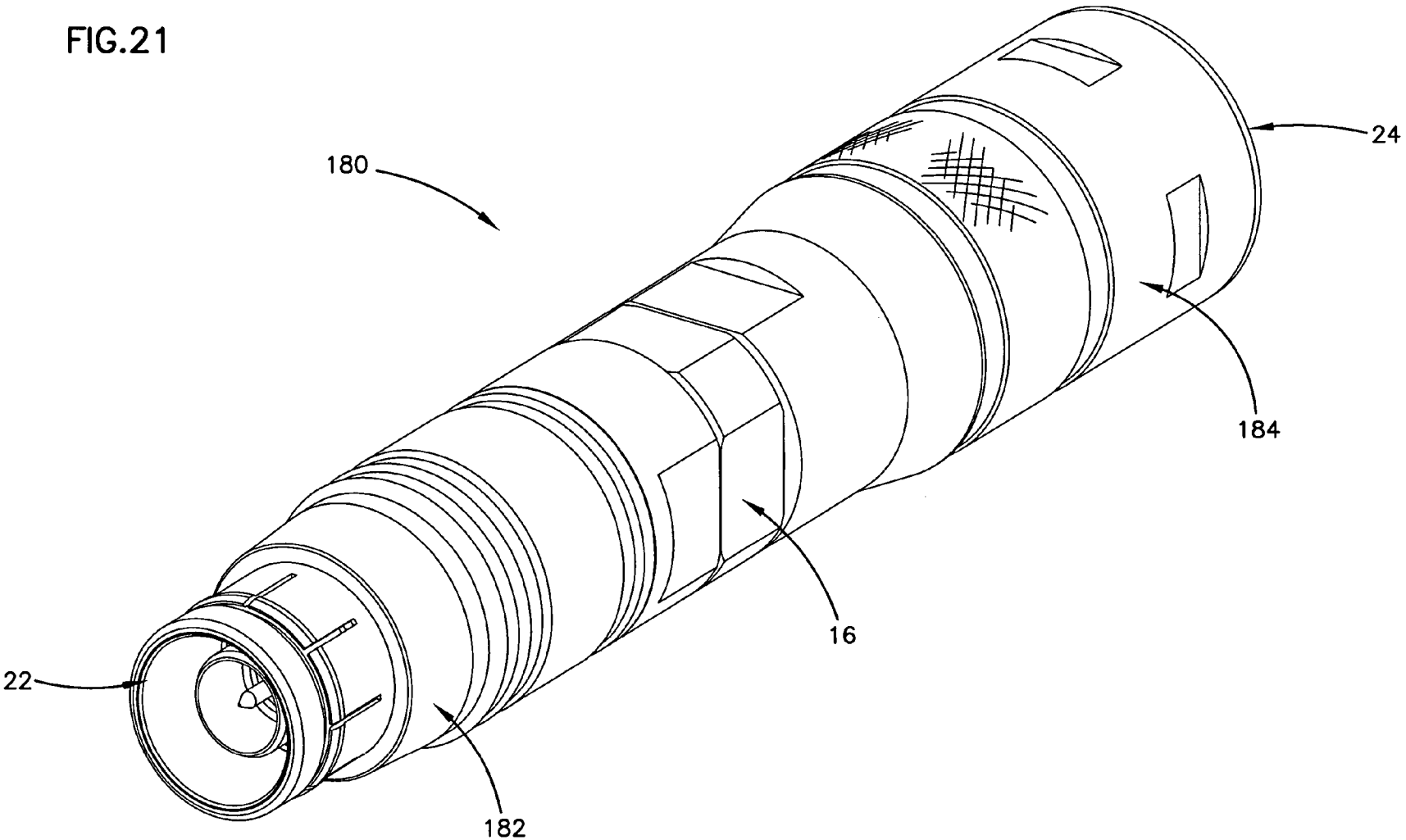
FIG. 21 is a perspective view of the triaxial cable connector adapter of FIG. 5, with a first male end of the first format and an opposing second female end of the second format mounted.
Figure 22:
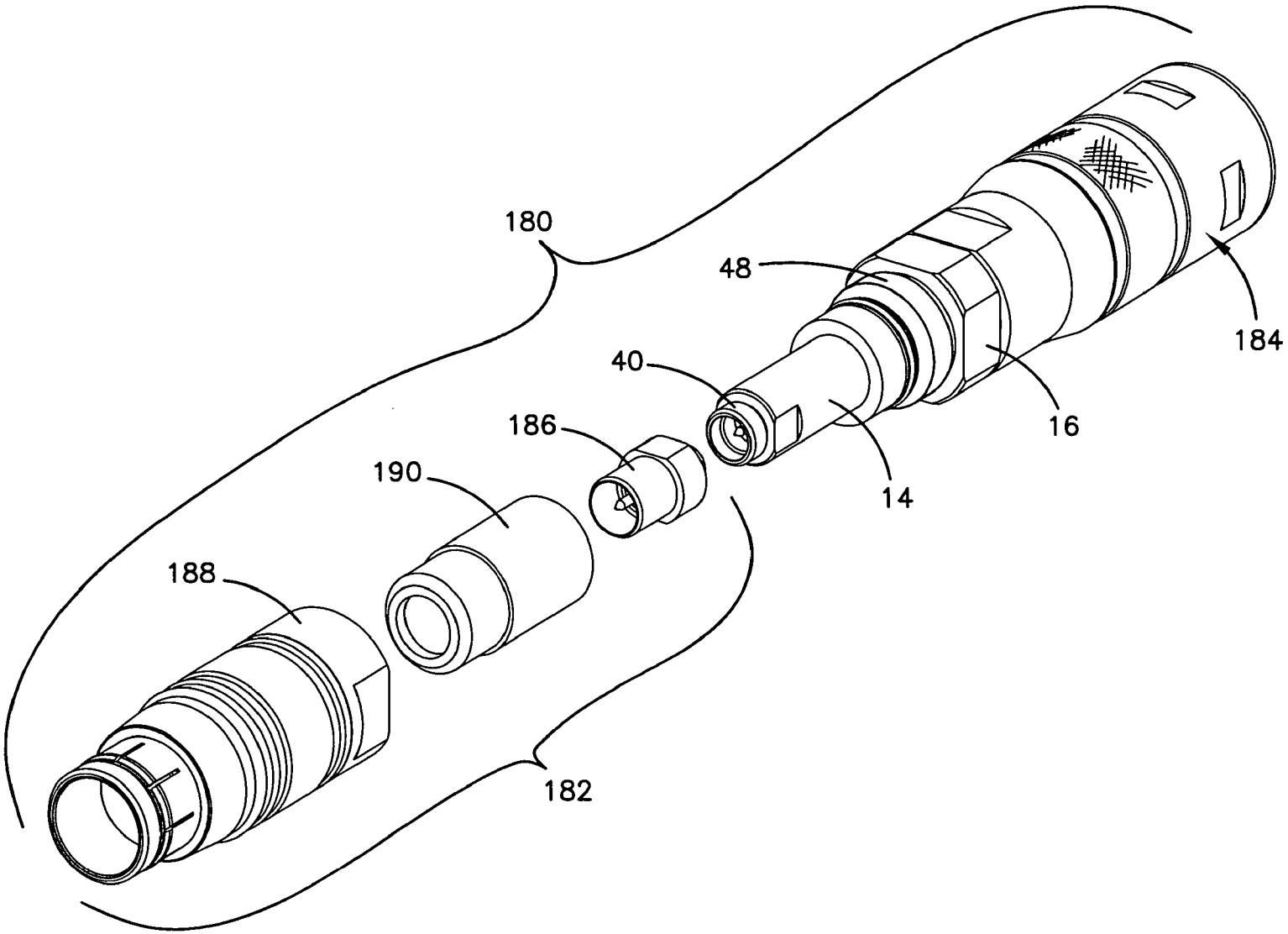
FIG. 22 is a perspective view of the triaxial cable connector adapter of FIG. 21, with the first end exploded.
Figure 23:
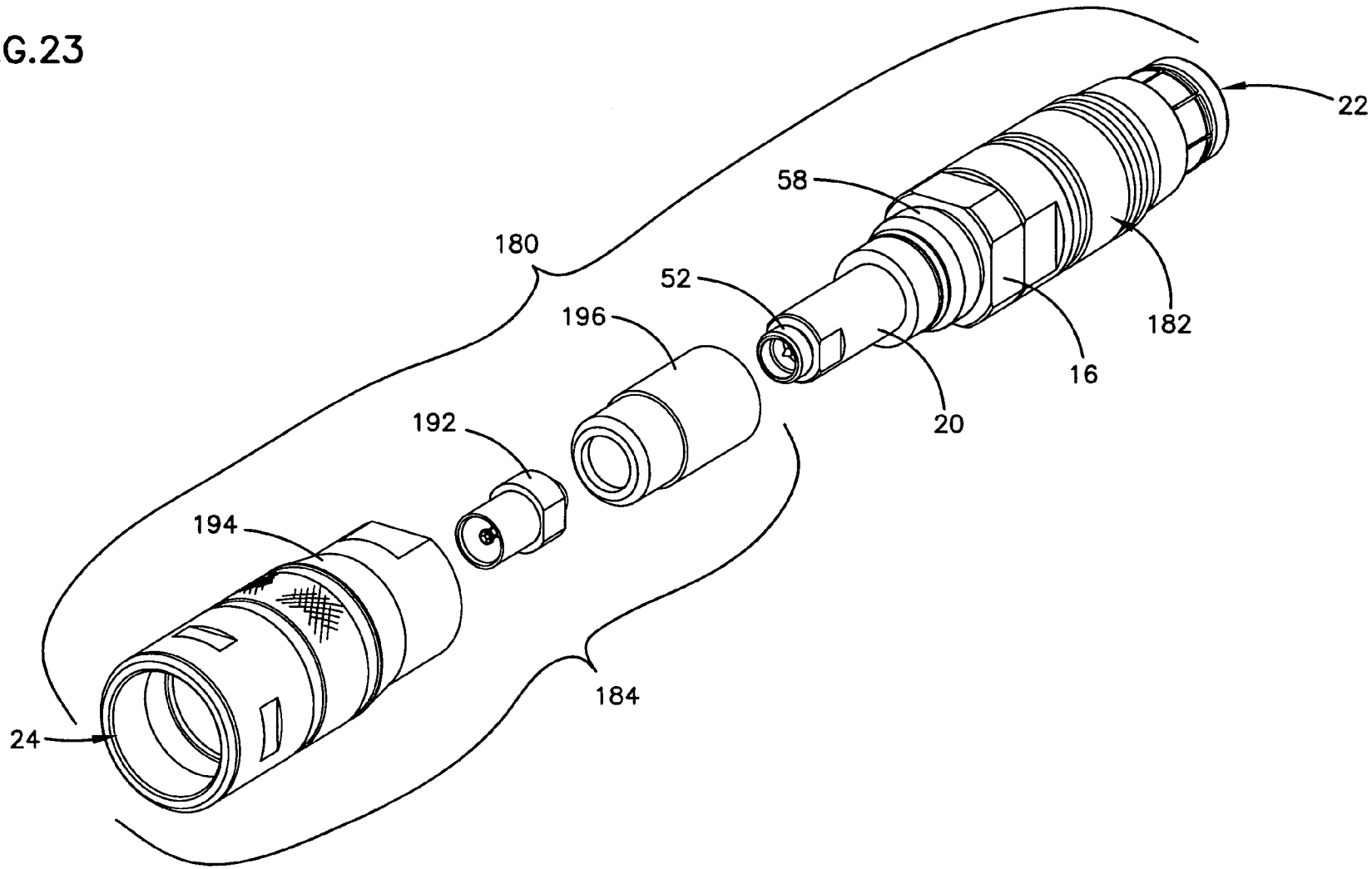
FIG. 23 is a second perspective view of the triaxial cable connector adapter of FIG. 21, with the second end exploded.

FIGS. 21 to 23 show a fifth alternative embodiment cable connector assembly 180 with an adapter 16, a first cable connector 182 and a second cable connector 184. First cable connector 182 of cable connector assembly 180 defines a male Global style connector with first mating end 22. Second cable connector 184 defines a female U.S. style connector with second mating end 24. First cable connector 182 includes a front shell assembly 186 mounted to threaded portion 40 of adapter 16 and an outer conductive body 188 mounted to threaded portion 48 of adapter 16, about first end 14. An outer insulator 190 is positioned between and electrically isolates front shell assembly 186 and outer conductive body 188.

Second cable connector 184 includes a front shell assembly 192 mounted to threaded portion 52 of adapter 16 and an outer conductive body 194 mounted to threaded portion 58 of adapter 16, about second end 20. An outer insulator 196 is positioned between and electrically isolates front shell assembly 192 and outer conductive body 194. The electrical connectivity between front shell assemblies 186 and 192, and outer conductive bodies 188 and 194 is similar to that described above with to cable connector assembly 10. Ends 22 and 24 are configured to mate with different style and gender triaxial cable connectors, otherwise cable connector assemblies 10 and 180 are functional identical.

Figure 24:
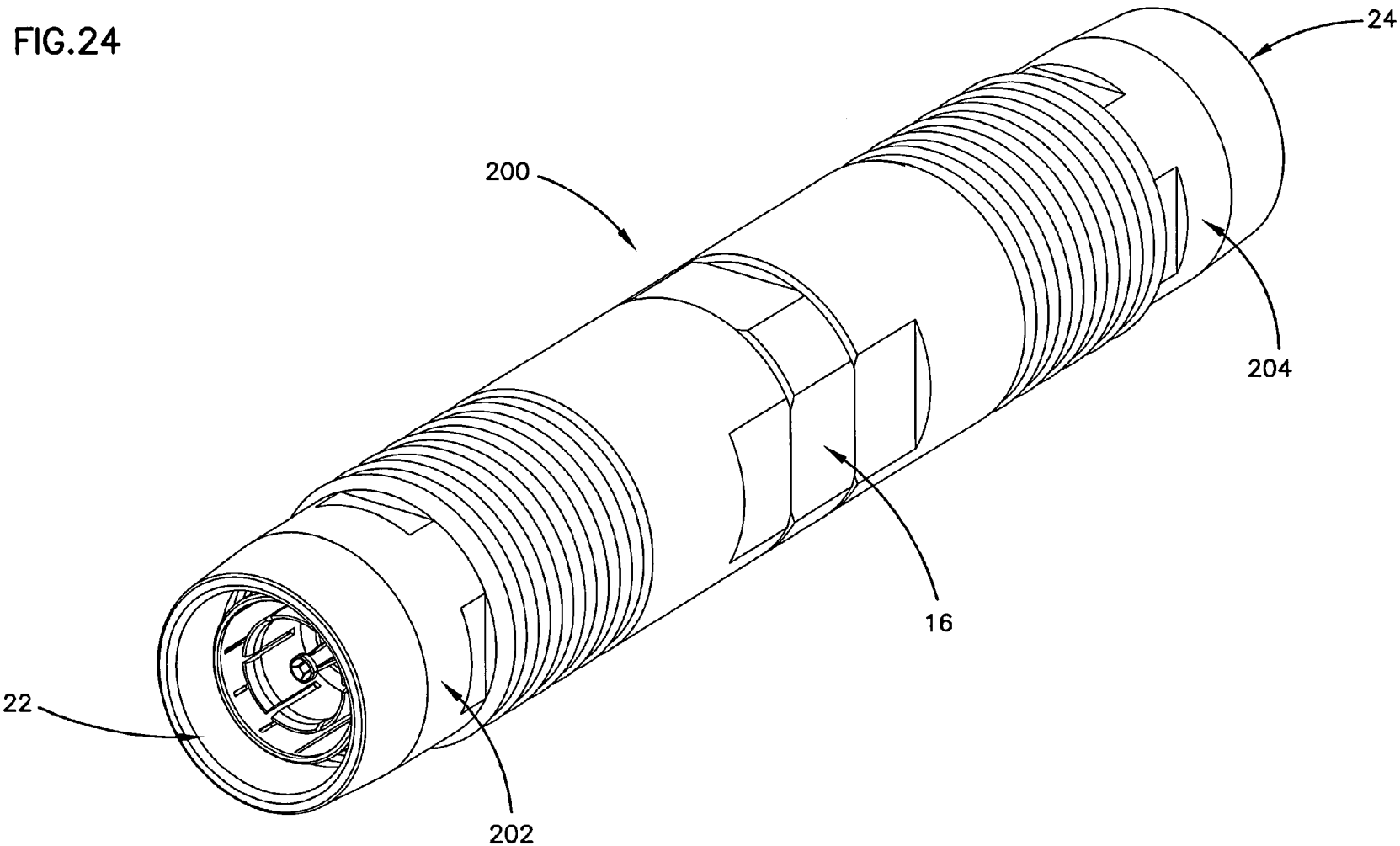
FIG. 24 is a perspective view of the triaxial cable connector adapter of FIG. 5, with opposing female ends of the first format mounted.
Figure 25:
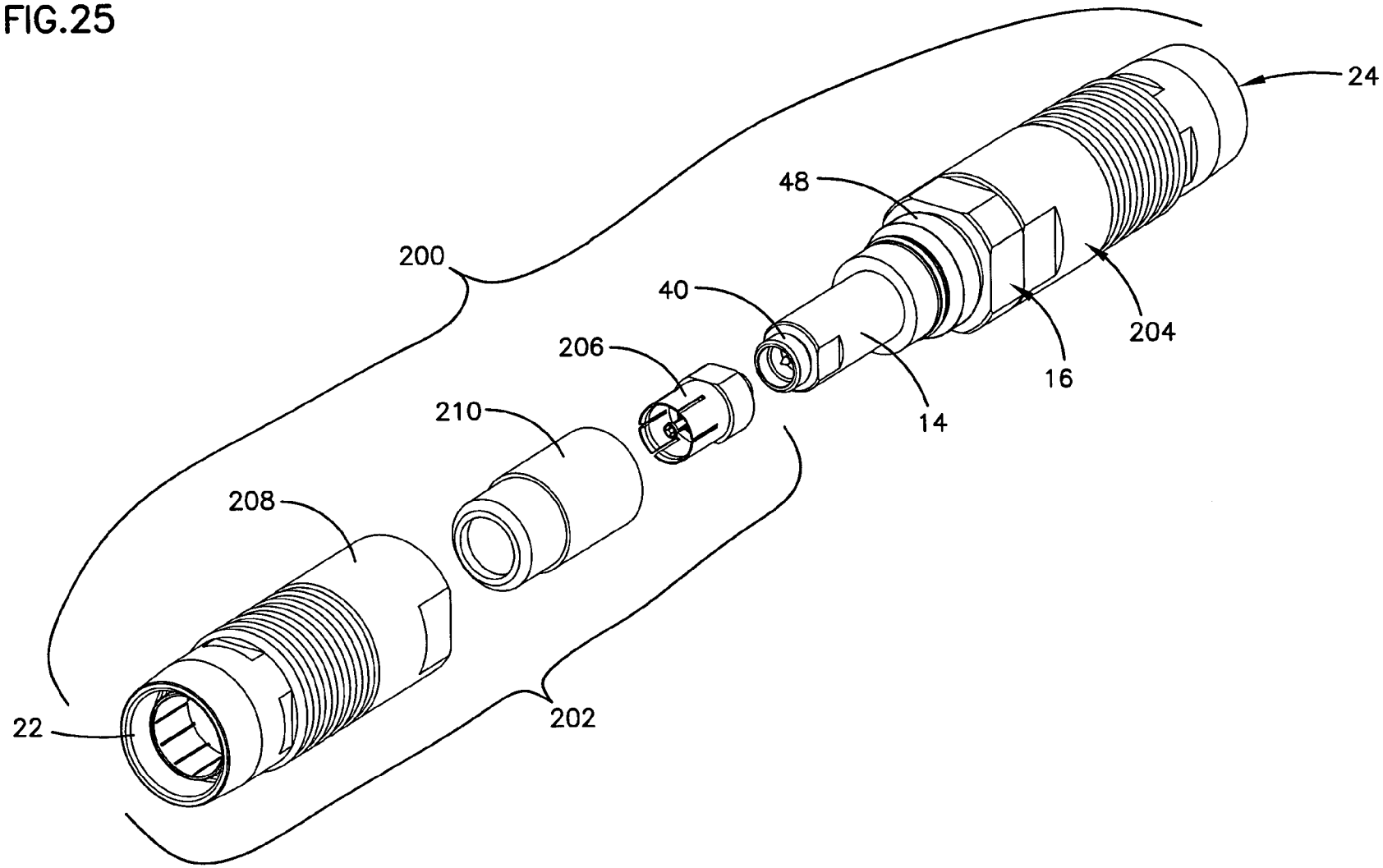
FIG. 25 is a perspective view of the triaxial cable connector adapter of FIG. 24, with the first end exploded.
Figure 26:
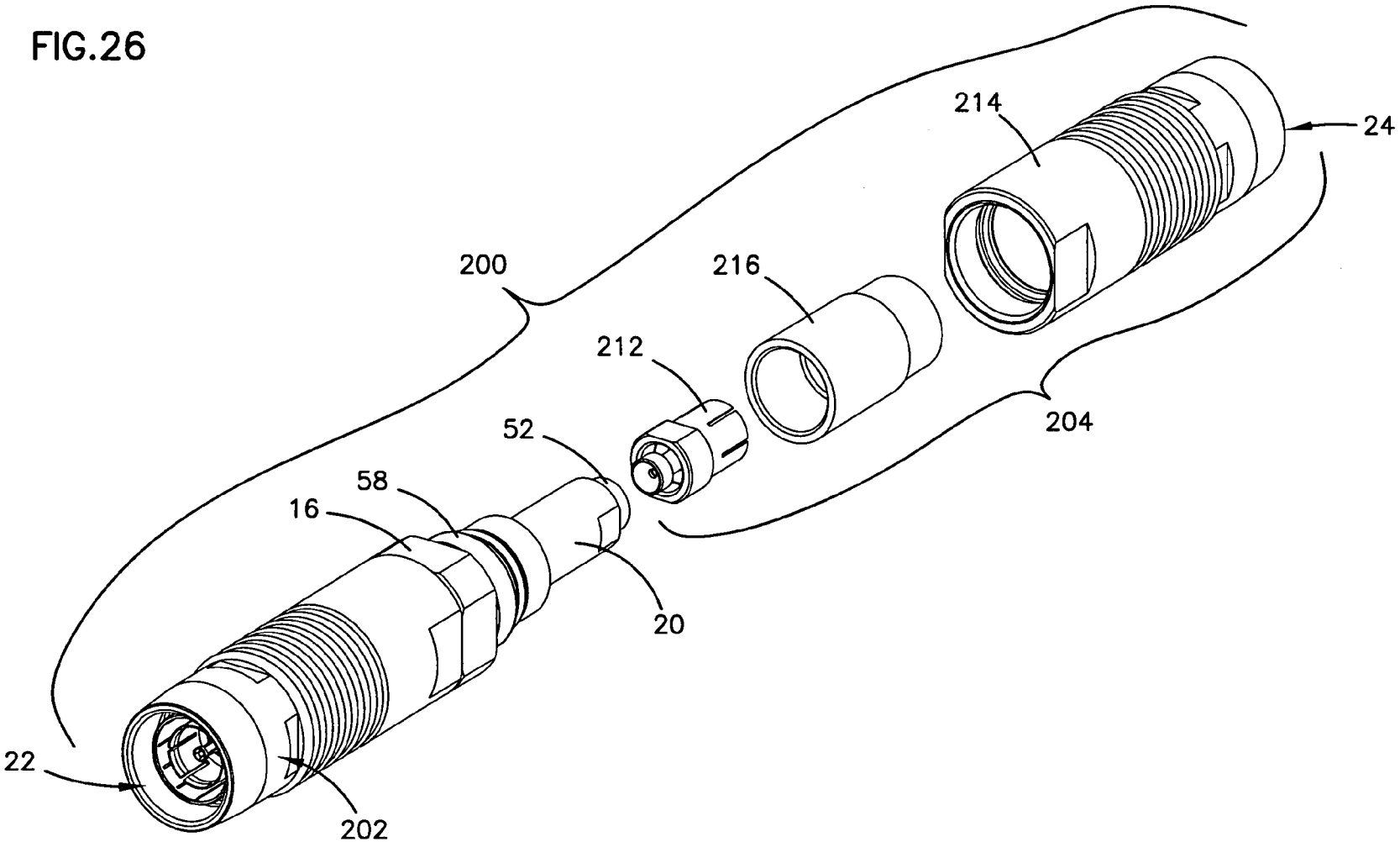
FIG. 26 is a perspective view of the triaxial cable connector adapter of FIG. 24, with the second end exploded.

FIGS. 24 to 26 show a sixth alternative embodiment cable connector assembly 200 with an adapter 16, a first cable connector 202 and a second cable connector 204. First cable connector 202 of cable connector assembly 200 defines a female Global style connector with first mating end 22.

Second cable connector 204 defines a female Global style connector with second mating end 24. First cable connector 202 includes a front shell assembly 206 mounted to threaded portion 40 of adapter 16 and an outer conductive body 208 mounted to threaded portion 48 of adapter 16, about first end 14. An outer insulator 210 is positioned between and electrically isolates front shell assembly 206 and outer conductive body 208.

Second cable connector 204 includes a front shell assembly 212 mounted to threaded portion 52 of adapter 16 and an outer conductive body 214 mounted to threaded portion 58 of adapter 16, about second end 20. An outer insulator 216 is positioned between and electrically isolates front shell assembly 212 and outer conductive body 214. The electrical connectivity between front shell assemblies 206 and 212, and outer conductive bodies 208 and 214 is similar to that described above with to cable connector assembly 10. Ends 22 and 24 are configured to mate with different style and gender triaxial cable connectors, otherwise cable connector assemblies 10 and 200 are functional identical.

Figure 27:
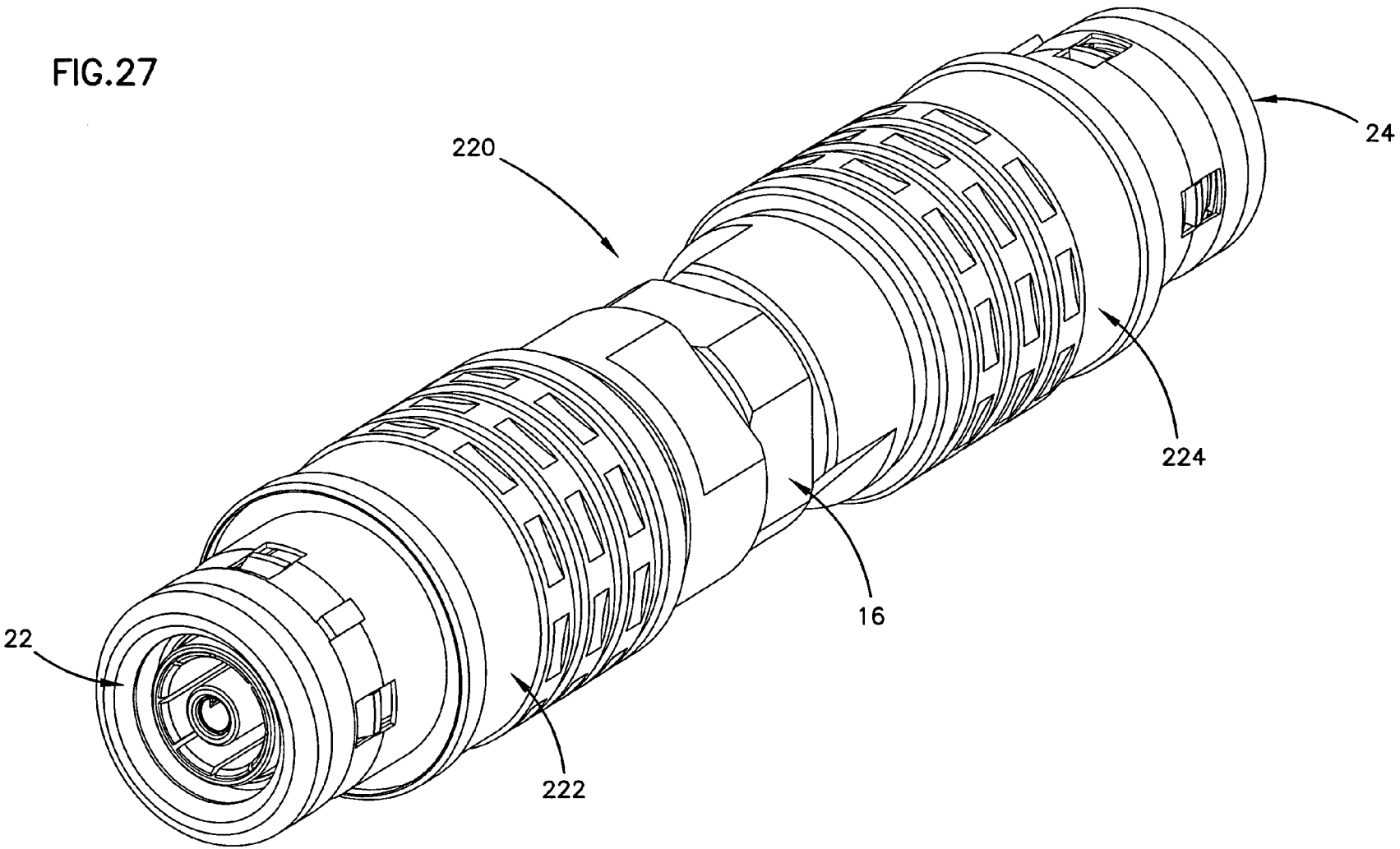
FIG. 27 is a perspective view of the triaxial cable connector adapter of FIG. 5, with opposing female ends of the third format mounted.
Figure 28:
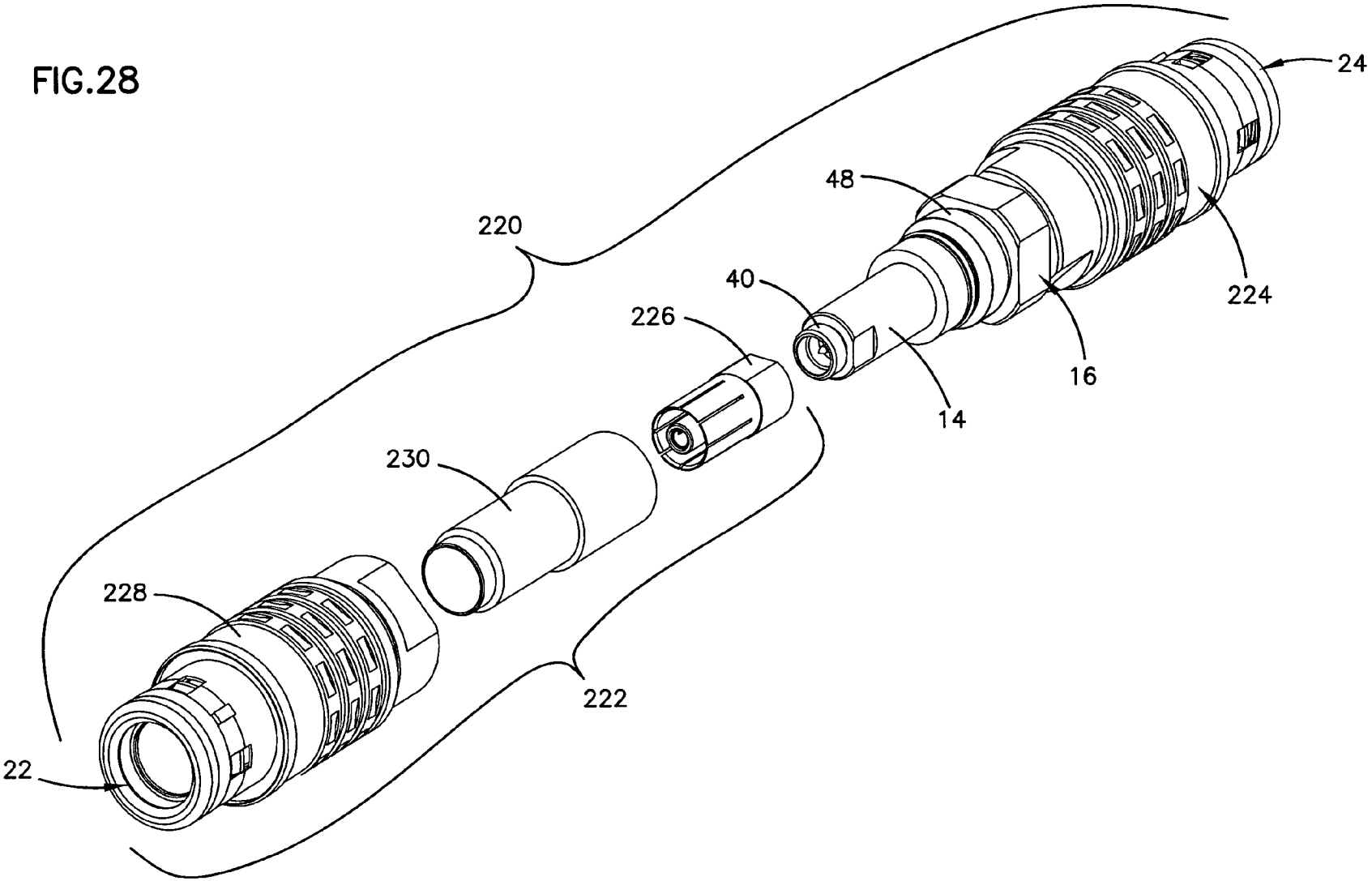
FIG. 28 is a perspective view of the triaxial cable connector adapter of FIG. 27, with the first end exploded.
Figure 29:
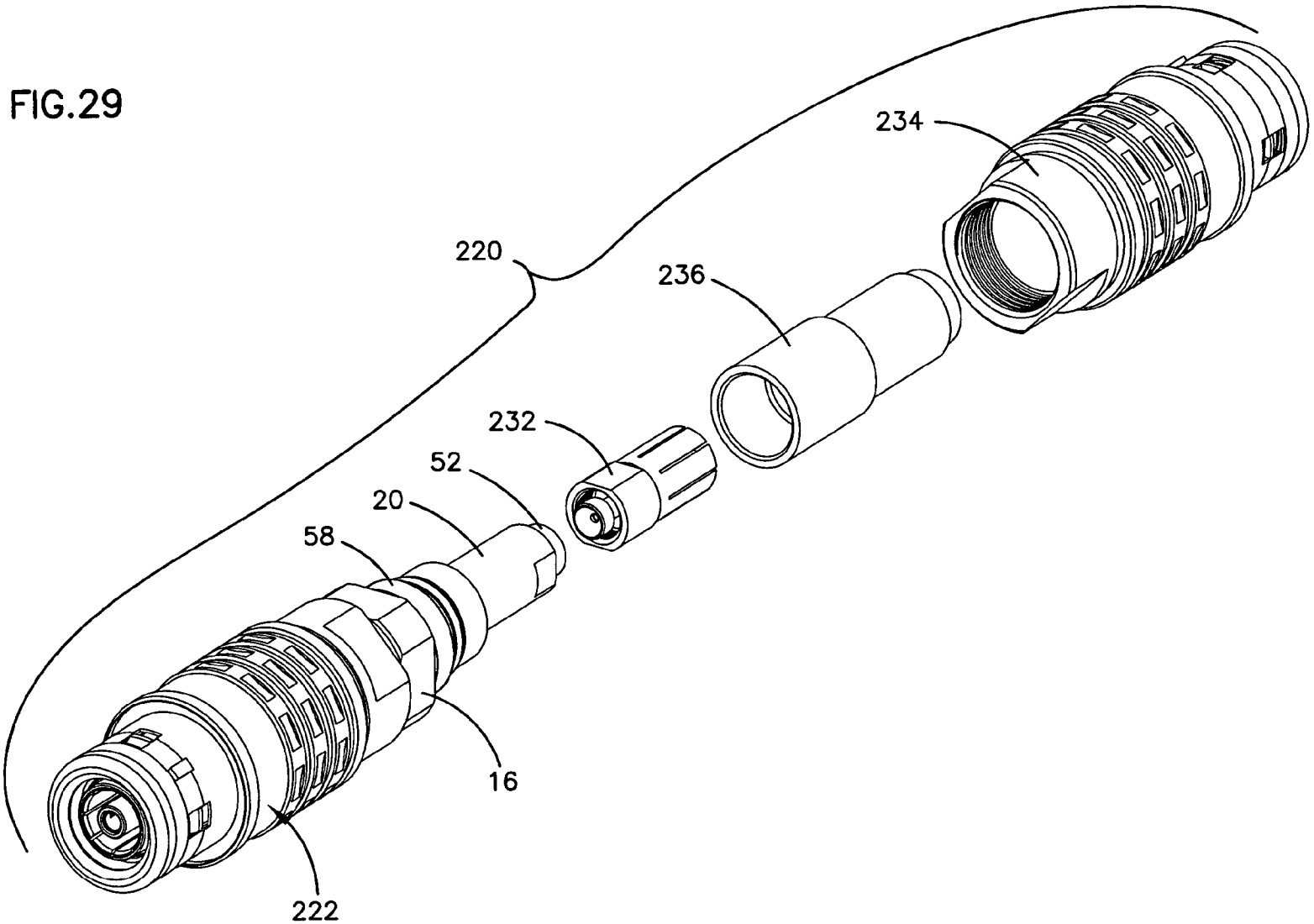
FIG. 29 is a perspective view of the triaxial cable connector adapter of FIG. 27, with the second end exploded.

FIGS. 27 to 29 show a seventh alternative embodiment cable connector assembly 220 with an adapter 16, a first cable connector 222 and a second cable connector 224. First cable connector 222 of cable connector assembly 220 defines a female BBC style connector with first mating end 22. Second cable connector 224 defines a female BBC style connector with second mating end 24. First cable connector 222 includes a front shell assembly 226 mounted to threaded portion 40 of adapter 16 and an outer conductive body 228 mounted to threaded portion 48 of adapter 16, about first end 14. An outer insulator 230 is positioned between and electrically isolates front shell assembly 226 and outer conductive body 228.

Second cable connector 224 includes a front shell assembly 232 mounted to threaded portion 52 of adapter 16 and an outer conductive body 234 mounted to threaded portion 58 of adapter 16, about second end 20. An outer insulator 236 is positioned between and electrically isolates front shell assembly 232 and outer conductive body 234. The electrical connectivity between front shell assemblies 226 and 232, and outer conductive bodies 228 and 234 is similar to that described above with to cable connector assembly 10. Ends 22 and 24 are configured to mate with different style and gender triaxial cable connectors, otherwise cable connector assemblies 10 and 220 are functional identical.

Figure 30:
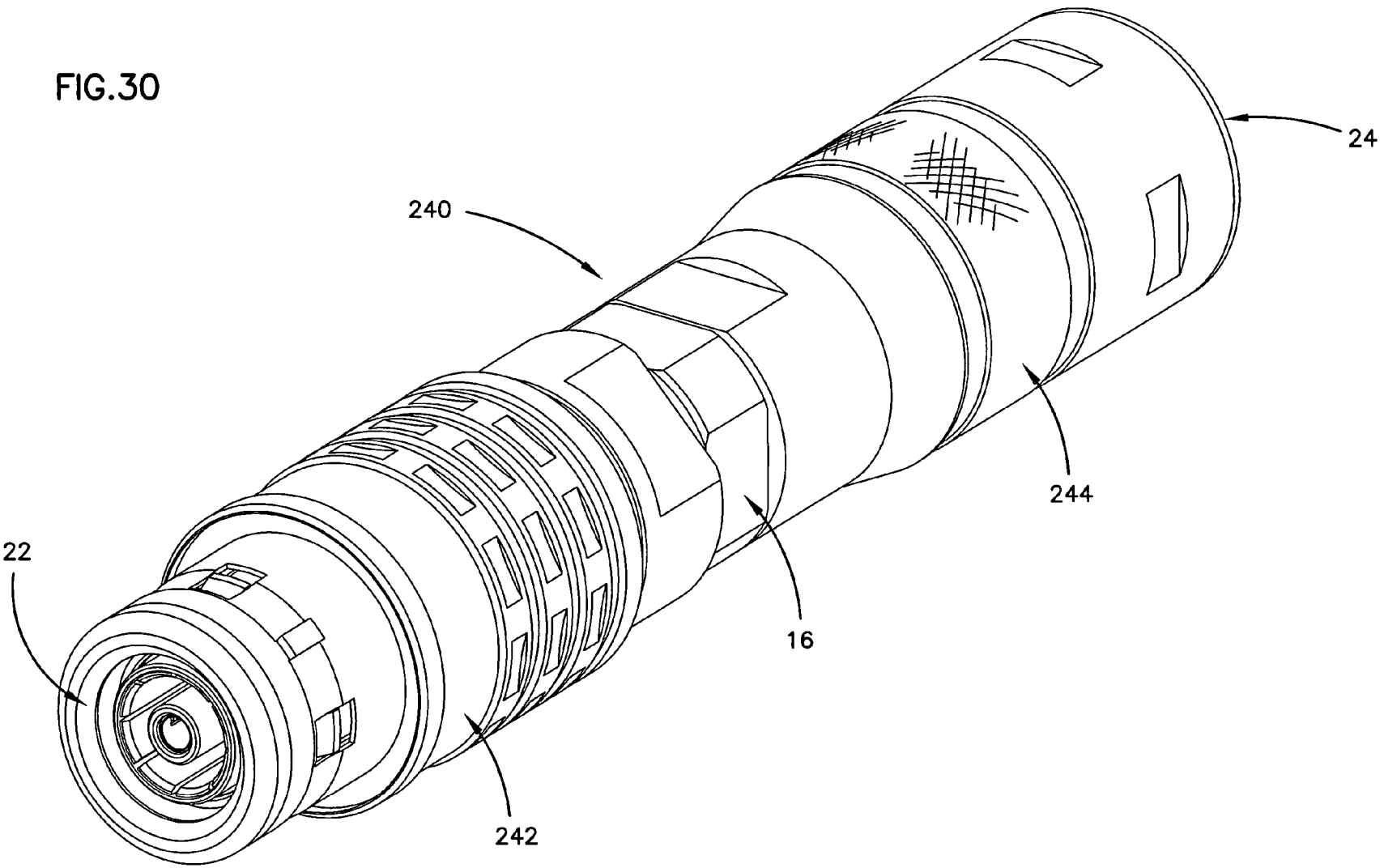
FIG. 30 is a perspective view of the triaxial cable connector adapter of FIG. 5, with a first female end of the third format and an opposing second female end of the second format mounted.
Figure 31:
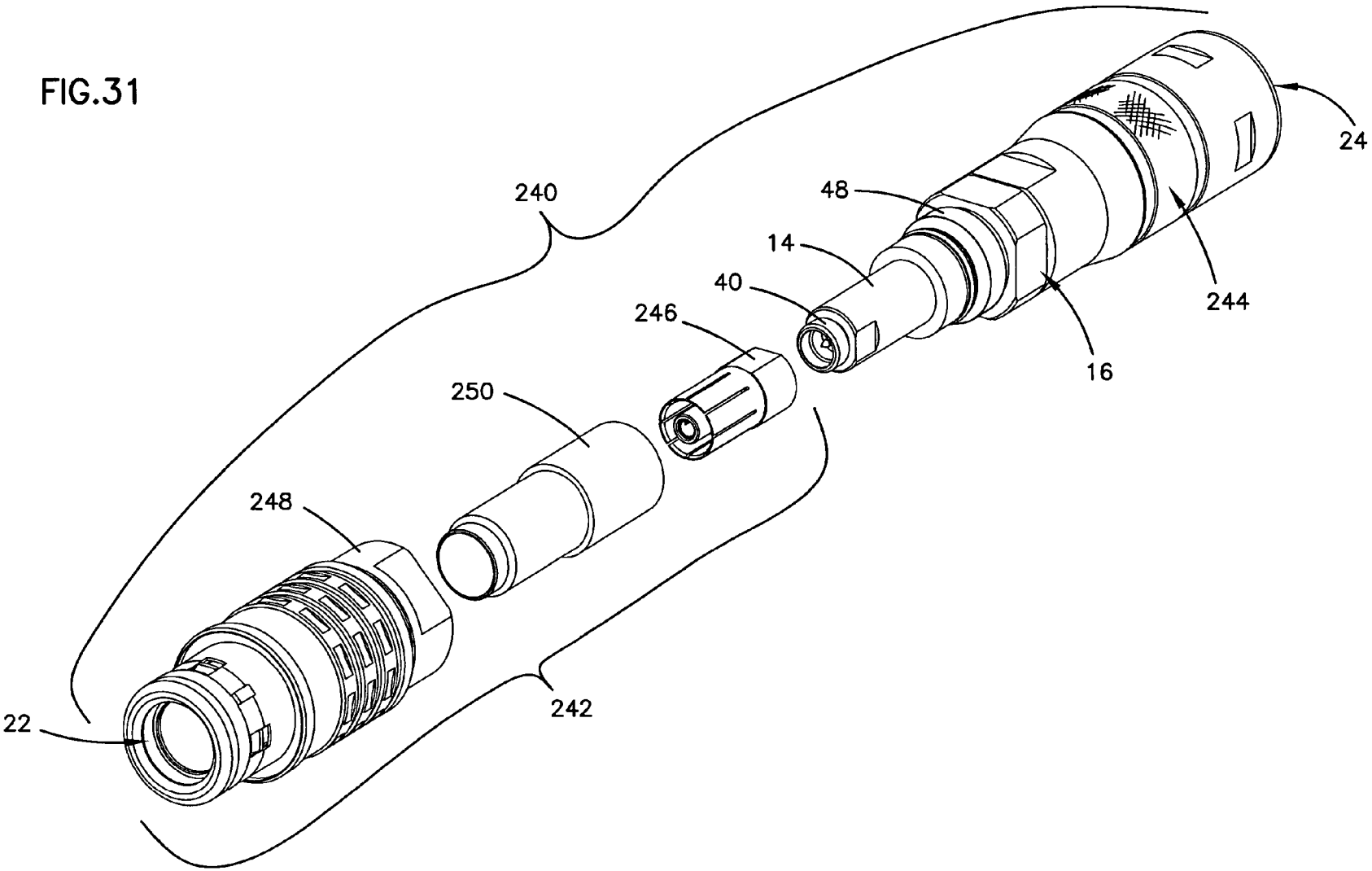
FIG. 31 is a perspective view of the triaxial cable connector adapter of FIG. 30, with the first end exploded.
Figure 32:
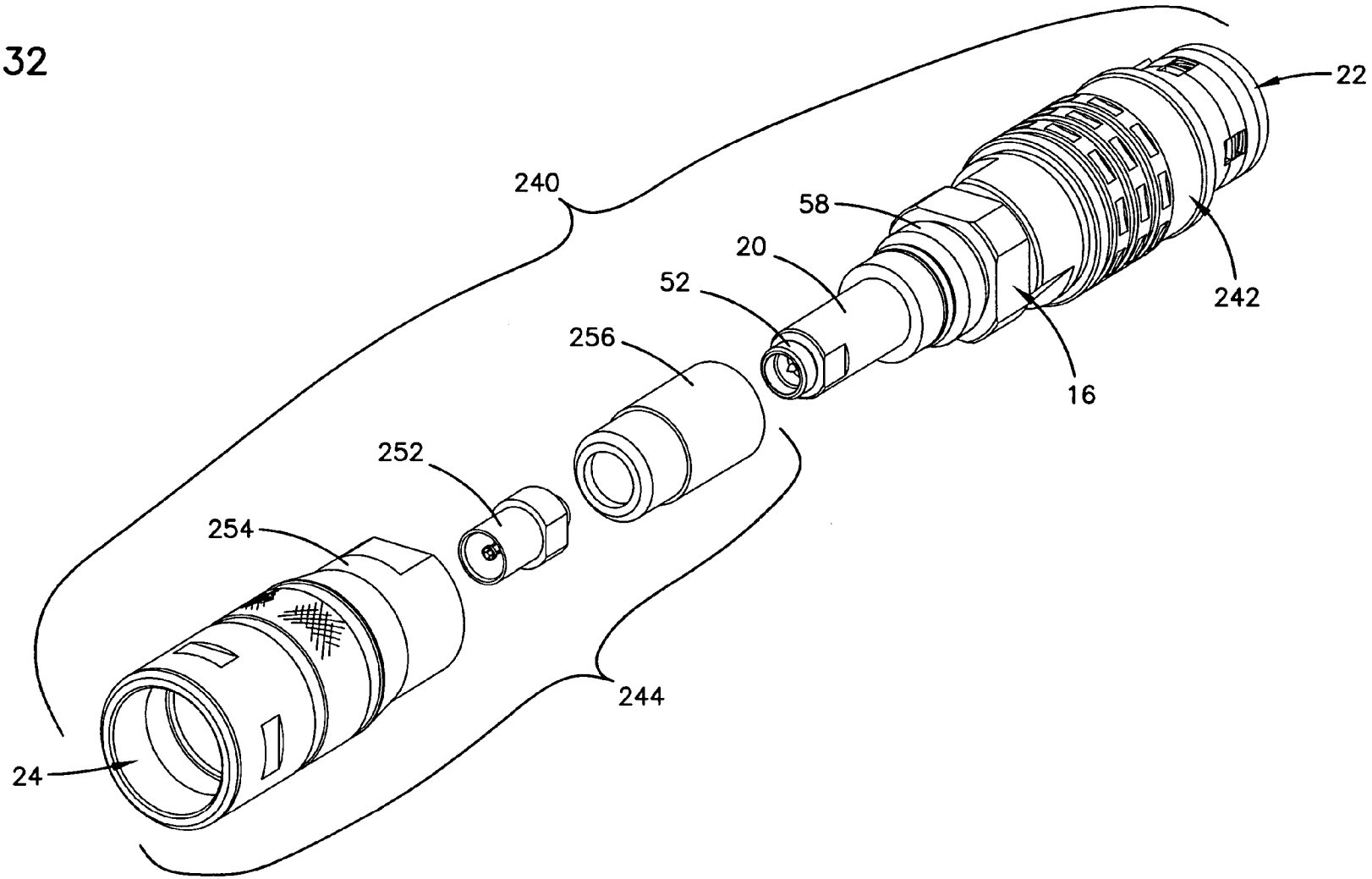
FIG. 32 is a second perspective view of the triaxial cable connector adapter of FIG. 30, with the second end exploded.

FIGS. 30 to 32 show an eighth alternative embodiment cable connector assembly 240 with an adapter 16, a first cable connector 242 and a second cable connector 244. First cable connector 242 of cable connector assembly 240 defines a female BBC style connector with first mating end 22. Second cable connector 244 defines a female U.S. style connector with second mating end 24. First cable connector 242 includes a front shell assembly 246 mounted to threaded portion 40 of adapter 16 and an outer conductive body 248 mounted to threaded portion 48 of adapter 16, about first end 14. An outer insulator 250 is positioned between and electrically isolates front shell assembly 246 and outer conductive body 248.

Second cable connector 244 includes a front shell assembly 252 mounted to threaded portion 52 of adapter 16 and an outer conductive body 254 mounted to threaded portion 58 of adapter 16, about second end 20. An outer insulator 256 is positioned between and electrically isolates front shell assembly 252 and outer conductive body 254. The electrical connectivity between front shell assemblies 246 and 252, and outer conductive bodies 248 and 254 is similar to that described above with to cable connector assembly 10. Ends 22 and 24 are configured to mate with different style and gender triaxial cable connectors, otherwise cable connector assemblies 10 and 240 are functional identical.

Figure 33:
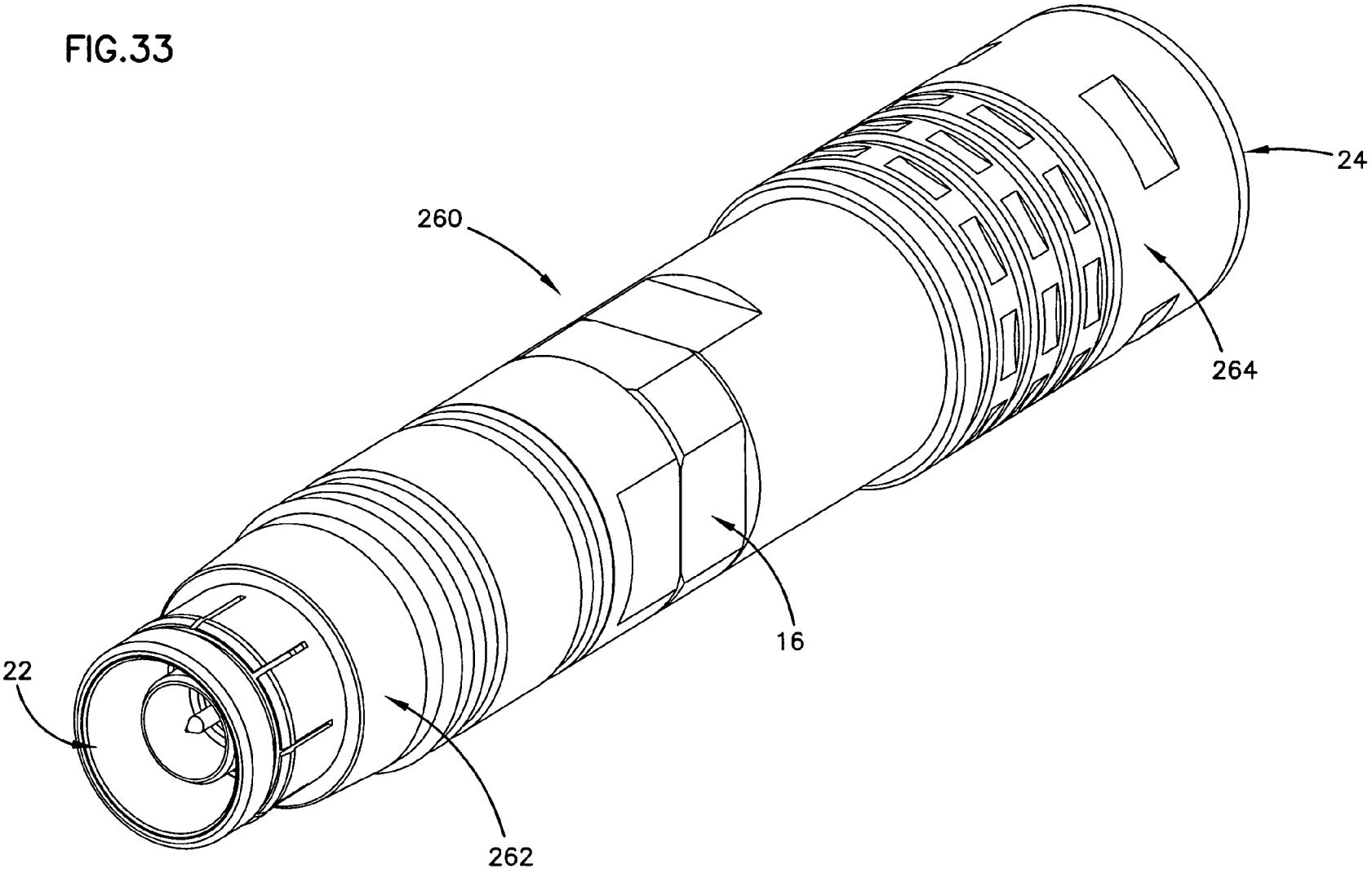
FIG. 33 is a perspective view of the triaxial cable connector adapter of FIG. 5, with a first male end of the first format and an opposing second male end of the third format mounted.
Figure 34:
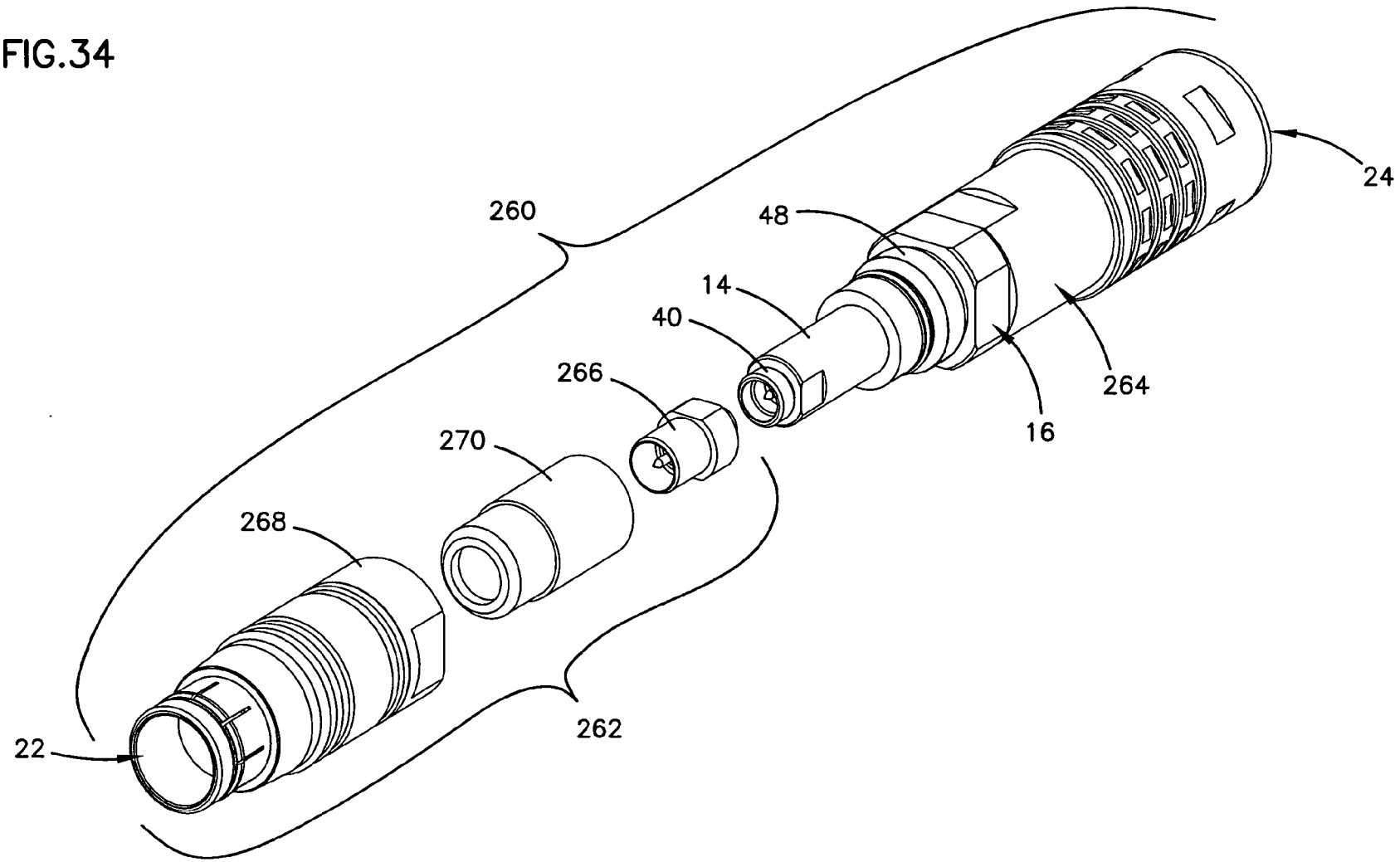
FIG. 34 is a perspective view of the triaxial cable connector adapter of FIG. 33, with the first end exploded.
Figure 35:
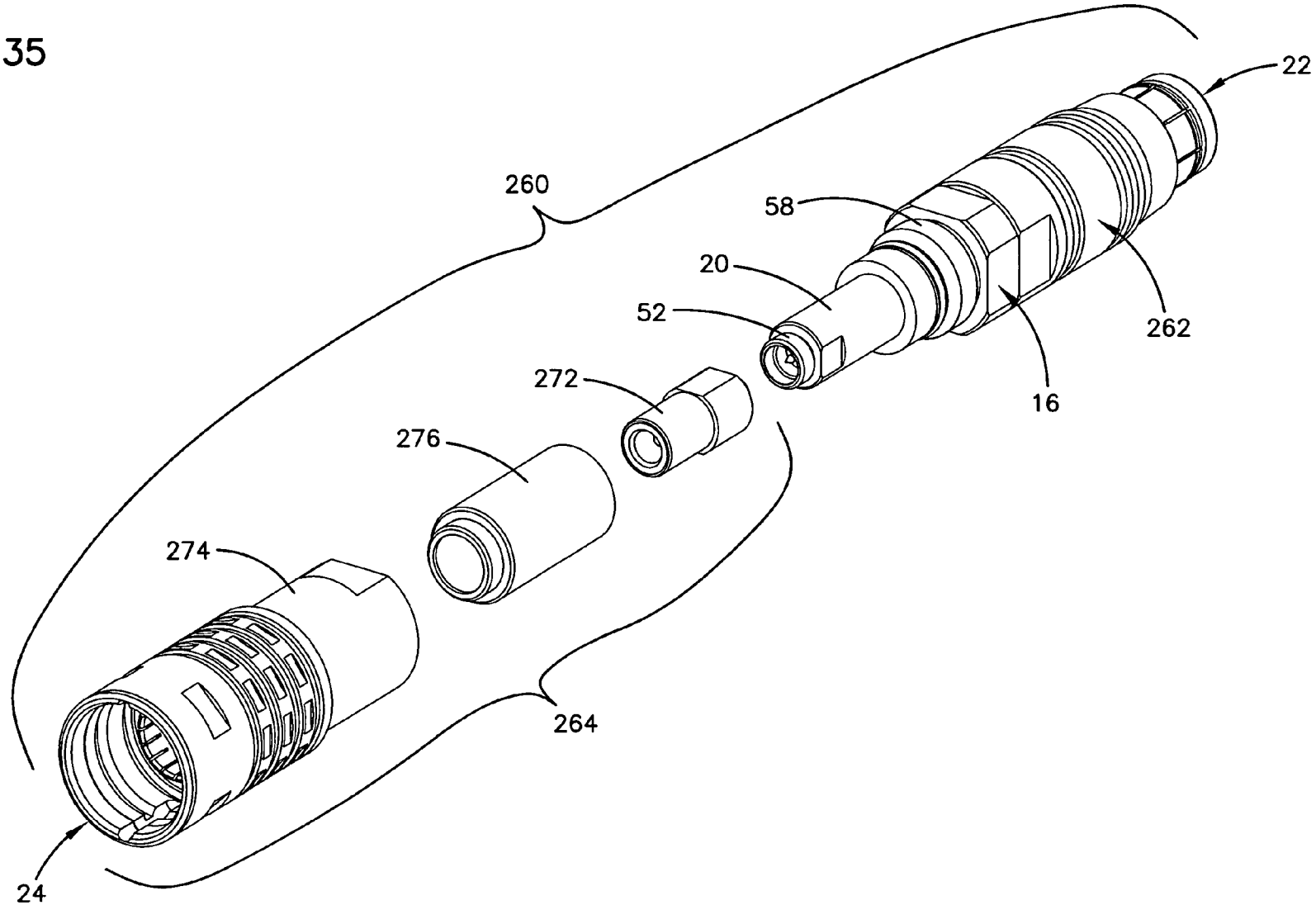
FIG. 35 is a second perspective view of the triaxial cable connector adapter of FIG. 33, with the second end exploded.

FIGS. 33 to 35 show a ninth alternative embodiment cable connector assembly 260 with an adapter 16, a first cable connector 262 and a second cable connector 264. First cable connector 262 of cable connector assembly 260 defines a male Global style connector with first mating end 22. Second cable connector 264 defines a male BBC style connector with second mating end 24. First cable connector 262 includes a front shell assembly 266 mounted to threaded portion 40 of adapter 16 and an outer conductive body 268 mounted to threaded portion 48 of adapter 16, about first end 14. An outer insulator 270 is positioned between and electrically isolates front shell assembly 266 and outer conductive body 268.

Second cable connector 264 includes a front shell assembly 272 mounted to threaded portion 52 of adapter 16 and an outer conductive body 274 mounted to threaded portion 58 of adapter 16, about second end 20. An outer insulator 276 is positioned between and electrically isolates front shell assembly 272 and outer conductive body 274. The electrical connectivity between front shell assemblies 266 and 272, and outer conductive bodies 268 and 274 is similar to that described above with to cable connector assembly 10. Ends 22 and 24 are configured to mate with different style and gender triaxial cable connectors, otherwise cable connector assemblies 10 and 260 are functional identical.

First and second mating ends 22 and 24 may be configured to mate with other current or future triaxial cable connectors through the use of different front shell assemblies, outer conductive bodies, and outer insulators. Alternatively, adapter 16 may be configured with mating ends 22 and 24 that mate with coaxial cable connectors with different front shell assemblies.

To convert mating end 22 to mate with a different gender or style of cable connector, the outer conductive body would be removed from the threaded portion 48 of adapter 16. Then, the outer insulator is removed from the front shell assembly and the front shell assembly removed from threaded portion 40 of first end 14 of adapter 16. A different combination of front shell assembly and outer conductive body are then mounted to threaded portions 40 and 48, respectively, with an appropriate outer insulator positioned between. Mating end 24 may be converted using a similar method.

The embodiments of the inventions disclosed herein have been discussed for the purpose of familiarizing the reader with novel aspects of the present invention. Although preferred embodiments have been shown and described, many changes, modifications, and substitutions may be made by one having skill in the art without unnecessarily departing from the spirit and scope of the present invention. Having described preferred aspects and embodiments of the present invention, modifications and equivalents of the disclosed concepts may readily occur to one skilled in the art. However, it is intended that such modifications and equivalents be included within the scope of the claims which are appended hereto.

What is claimed is:

1. A coaxial connector assembly comprising:

(a) an adapter including:

(1) a first and a second end, (2) a center conductor and a first outer conductive shell at each end;

wherein the center conductors of each end are electrically connected and the first outer conductive shells of each end are electrically connected, and the center conductors are electrically isolated from the first outer conductive shells;

(b) a first connector removably mounted to the first end of the adapter, the first connector including a first end and a second end, the second end of the first connector adapted to engage the first end of the adapter and the first end of the first connector adapted to mate with a first coaxial cable connector terminated to a cable;

(c) a second connector removably mounted to the second end of the adapter, the second connector including a first end and a second end, the second end of the second connector adapted to engage the second end of the adapter and the first end of the second connector adapted to mate with a second coaxial cable connector terminated to a cable.

2. The coaxial connector assembly of claim 1, wherein the first end of each of the first and second connector ends defines one of a plurality of genders and one of a plurality of styles.

3. The coaxial connector assembly of claim 2, wherein the plurality of genders includes male and female.

4. The coaxial connector assembly of claim 2, wherein the plurality of styles includes U.S., BBC, and Global.

5. The coaxial connector assembly of claim 2, wherein the first end of the first connector defines a different gender and a different style than the first end of the second connector.

6. The coaxial connector assembly of claim 2, wherein the first end of the first connector defines a different gender and the same style as the first end of the second connector.

7. The coaxial connector assembly of claim 2, wherein the first end of the first connector defines the same gender and the same style as the first end of the second connector.

8. The coaxial connector assembly of claim 2, wherein the first connector is threadably mounted to the first end of the adapter.

9. The coaxial connector assembly of claim 2, wherein the second connector is threadably mounted to the second end of the adapter.

10. A coaxial connector assembly comprising:

(a) an adapter including:

(1) a first and a second end, (2) a center conductor and a first outer conductive shell at each end;

wherein the center conductors of each end are electrically connected and the first outer conductive shells of each end are electrically connected, and the center conductors are electrically isolated from the first outer conductive shells;

(b) a first connector removably mounted to the adapter about the first outer conductive shell at the first end of the adapter, the first connector including:

(1) a first center conductor electrically connected to the center conductor of the first end of the adapter;

(2) a first conductive front shell electrically connected to the first outer conductive shell of the first end of the adapter;

(3) a first insulator mounted between and electrically isolating the first center conductor and the first conductive front shell;

the first connector including a first end and a second end, the second end of the first connector adapted to releasably engage the first end of the adapter and the first end of the first connector adapted to mate with a first coaxial connector terminated to a cable;

(c) a second connector removably mounted to the adapter about the first outer conductive shell at the second end of the adapter, the second connector including:

(1) a second center conductor electrically connected to the center conductor of the second end of the adapter;

(2) a second conductive front shell electrically connected to the first outer conductive shell of the second end of the adapter;

(3) a second insulator mounted between and electrically isolating the second center conductor and the second conductive front shell;

the second connector including a first end and a second end, the second end of the second connector adapted to releasably engage the second end of the adapter and the first end of the second connector adapted to mate with a second coaxial connector terminated to a cable.

11. The coaxial connector assembly of claim 10, further comprising a first conductive outer body releasably mounted to the adapter about the first conductive front shell, with an insulator positioned between the first conductive outer body and the first conductive front shell; and a second conductive outer body releasably mounted to the adapter about the second conductive front shell, with an insulator positioned between the second conductive outer body and the second conductive front shell;

wherein the first and second conductive outer bodies are electrically connected to each other.

12. The coaxial connector assembly of claim 11, wherein the first conductive outer body, the first conductive front shell and the first center conductor cooperatively define a first triaxial mating end of a first gender and a first style adapted to mate with a first triaxial connector, and the second conductive outer body, the second conductive front shell and the second center conductor cooperatively define a second triaxial mating end with a second gender and a second style adapted to mate with a second triaxial connector.

13. The coaxial connector assembly of claim 12, wherein the first mating end is the same style and the same gender as the second mating end.

14. The coaxial connector assembly of claim 12, wherein the first mating end is the same style and a different gender as the second mating end.

15. The coaxial connector assembly of claim 12, wherein the first mating end is a different style and the same gender as the second mating end.

16. The coaxial connector assembly of claim 12, wherein the first mating end is a different style and a different gender as the second mating end.

17. The coaxial connector assembly of claim 12, wherein the first conductive outer body, the first conductive front shell and the first center conductor may be removed and replaced with a third conductive outer body, a third conductive front shell and a third center conductor to define a third mating end with the same style and a different gender as the first end.

18. The coaxial connector assembly of claim 12, wherein the first conductive outer body, the first conductive front shell and the first center conductor may be removed and replaced with a third conductive outer body, a third conductive front shell and a third center conductor to define a third mating end with a different style and the same gender as the first end.

19. The coaxial connector assembly of claim 12, wherein the first conductive outer body, the first conductive front shell and the first center conductor may be removed and replaced with a third conductive outer body, a third conductive front shell and a third center conductor to define a third mating end with a different style and a different gender as the first end.

20. The coaxial connector assembly of claim 12, wherein the style of the first triaxial mating end and the style of the second triaxial mating end are one of a global standard style, a U.S. standard style and a BBC standard style.

21. A coaxial connector adapter comprising:

a central housing defining a central axial opening with a first end and a second end, an outer portion of the central housing proximate each end threaded to receive a conductive outer body, wherein the outer body is adapted for mating with a connector terminated to a cable;

an outer insulator mounted within the central axial opening of the central housing;

a first conductive shell extending through the outer insulator beyond the first and second ends of the central housing, the first conductive shell including a first end and a second end each threaded to receive a shell assembly, and the outer insulator electrically isolating the first conductive shell from the central housing;

an inner insulator mounted within the central axial opening of the central housing; and a center conductor extending between the first and second ends of the central housing through the central axial opening mounted within the inner insulator.

22. The coaxial connector adapter of claim 21, wherein the first conductive outer shell is formed of two parts, one part inserted through each of the first and second ends.

23. The coaxial connector adapter of claim 22, wherein the inner insulator is formed of two parts, and one inner insulator part is mounted within each of the parts of the outer conductive shell.

24. The coaxial connector adapter of claim 21, wherein the outer insulator is formed of two parts, one part inserted through each of the first and second ends.

25. A triaxial cable connector system comprising:

(a) an adapter with first and second ends;

(b) a first connector selectively releasably mounted to the first end of the adapter, the first connector including a first end and a second end, the second end of the first connector adapted to engage the first end of the adapter and the first end of the first connector adapted to mate with a first coaxial cable connector terminated to a cable, the first connector also including:

(1) a front shell assembly including a conductive front shell and a center conductor mounted within and electrically isolated from the conductive front shell by a center conductor insulator;

(2) an outer insulator positioned about the front shell assembly;

(3) a conductive outer body positioned about the outer insulator and electrically isolated from the front shell assembly;

wherein the first connector defines a first connector gender and style;

(c) a second connector selectively releasably mounted to the second end of the adapter, the second connector including a first end and a second end, the second end of the second connector adapted to engage the second end of the adapter and the first end of the second connector adapted to mate with a second coaxial cable connector terminated to a cable, the second connector also including:

(1) a front shell assembly including a conductive front shell and a center conductor mounted within and electrically isolated from the conductive front shell by a center conductor insulator;

(2) an outer insulator positioned about the front shell assembly;

(3) a conductive outer body positioned about the outer insulator and electrically isolated from the front shell assembly;

wherein the second connector defines a second connector gender and style;

(d) a third connector including:

(1) a front shell assembly including a conductive front shell and a center conductor mounted within and electrically isolated from the conductive front shell by a center conductor insulator;

(2) an outer insulator positioned about the front shell assembly;

(3) a conductive outer body positioned about the outer insulator and electrically isolated from the front shell assembly;

wherein the third connector defines a third connector gender and style;

wherein the center conductor of the first connector is electrically connected to the center conductor of the second connector, the front shell of the first connector is electrically connected to the front shell of the second connector, and the conductive outer body of the first connector is electrically connected to the conductive outer body of the second connector; and wherein either of the first or the second connectors may be removed from the adapter and replaced with the third connector so that the center conductor of the third connector becomes electrically connected to the center conductor of either the first connector or the second connector, the front shell of the third connector becomes electrically connected to the front shell of either the first connector or the second connector, and the conductive outer body of the third connector becomes electrically connected to the conductive outer body of either the first connector or the second connector.

26. The triaxial cable connector system of claim 25, wherein the first, second and third connectors may define one of a male or a female gender.

27. The triaxial cable connector system of claim 25, wherein the first, second and third connectors may define one of a U.S., BBC, or a Global style.

28. The triaxial cable connector system of claim 25, wherein the first and second connectors define the same gender and different styles.

29. The triaxial cable connector system of claim 25, wherein the first and second connectors define different genders and the same style.

30. The triaxial cable connector system of claim 25, wherein the first and second connectors define different genders and different styles.

31. The triaxial cable connector system of claim 25, wherein the first and second connectors define the same gender and the same style.

32. The triaxial cable connector system of claim 25, wherein the third connector defines the same gender and a different style as the connector it replaces.

33. The triaxial cable connector system of claim 25, wherein the third connector defines a different gender and the same style as the connector it replaces.

34. The triaxial cable connector system of claim 25, wherein the third connector defines a different gender and a different style as the connector it replaces.

35. A method of assembling a triaxial cable connector adapter comprising:

providing an adapter housing with first and second ends;

selecting a first connector of a first gender selected from a plurality of genders and a first style selected from a plurality of styles, and having first and second ends, wherein a second end of the first connector is adapted to engage the first end of the adapter and a first end of the first connector is adapted to mate with a first coaxial cable connector terminated to a cable;

removably mounting the first connector to the first end of the adapter housing;

selecting a second connector of a second gender selected from a plurality of genders and a second style selected from a plurality of styles, and having first and second ends, wherein a second end of the second connector is adapted to engage the second end of the adapter and a first end of the second connector is adapted to mate with a second coaxial cable connector terminated to a cable; and removably mounting the second connector to the second end of the adapter housing.

36. The method of claim 35, wherein the plurality of genders includes male and female.

37. The method of claim 35, wherein the plurality of styles includes U.S., BBC, and Global.

* * * * *